US010934895B2

(12) United States Patent
Held et al.

(10) Patent No.: US 10,934,895 B2
(45) Date of Patent: Mar. 2, 2021

(54) HEAT ENGINE SYSTEMS WITH HIGH NET POWER SUPERCRITICAL CARBON DIOXIDE CIRCUITS

(71) Applicant: ECHOGEN POWER SYSTEMS, L.L.C., Akron, OH (US)

(72) Inventors: Timothy Held, Akron, OH (US); Joshua Giegel, Streetsboro, OH (US)

(73) Assignee: ECHOGEN POWER SYSTEMS, LLC, Akron, OH (US)

( * ) Notice: Subject to any disclaimer, the term of this patent is extended or adjusted under 35 U.S.C. 154(b) by 901 days.

(21) Appl. No.: 14/772,404

(22) PCT Filed: Mar. 4, 2014

(86) PCT No.: PCT/US2014/020242
§ 371 (c)(1),
(2) Date: Sep. 3, 2015

(87) PCT Pub. No.: WO2014/138035
PCT Pub. Date: Sep. 12, 2014

(65) Prior Publication Data
US 2016/0003108 A1 Jan. 7, 2016

Related U.S. Application Data

(60) Provisional application No. 61/818,355, filed on May 1, 2013, provisional application No. 61/782,400, filed
(Continued)

(51) Int. Cl.
*F01K 23/02* (2006.01)
*F01K 25/10* (2006.01)
(Continued)

(52) U.S. Cl.
CPC ..... *F01K 23/02* (2013.01); *F01K 3/18* (2013.01); *F01K 23/10* (2013.01); *F01K 23/12* (2013.01); *F01K 25/103* (2013.01)

(58) Field of Classification Search
CPC . F01K 23/02; F01K 23/10; F01K 3/18; F01K 23/12; F01K 25/103
(Continued)

(56) References Cited

U.S. PATENT DOCUMENTS 1,433,883 A 10/1922 Friderich
1,969,526 A 2/1934 Rosch
(Continued)

FOREIGN PATENT DOCUMENTS

CA 2794150 A1 11/2011
CN 1165238 A 11/1997
(Continued)

OTHER PUBLICATIONS

Alpy, N., et al., "French Atomic Energy Commission views as regards SCO2 Cycle Development priorities and related R&D approach," Presentation, Symposium on SCO2 Power Cycles, Apr. 29-30, 2009, Troy, NY, 20 pages.
(Continued)

*Primary Examiner* — Hoang M Nguyen
(74) *Attorney, Agent, or Firm* — Nolte Lackenbach Siegel

(57) ABSTRACT

Provided herein are heat engine systems and methods for transforming energy, such as generating mechanical energy and/or electrical energy from thermal energy. The heat engine systems may have one of several different configurations of a working fluid circuit. One configuration of the heat engine system contains at least four heat exchangers and at least three recuperators sequentially disposed on a high pressure side of the working fluid circuit between a system pump and an expander. Another configuration of the
(Continued)

heat engine system contains a low-temperature heat exchanger and a recuperator disposed upstream of a split flowpath and downstream of a recombined flowpath in the high pressure side of the working fluid circuit.

20 Claims, 15 Drawing Sheets

Related U.S. Application Data on Mar. 14, 2013, provisional application No. 61/772,204, filed on Mar. 4, 2013.

(51) Int. Cl.
*F01K 23/10* (2006.01)
*F01K 3/18* (2006.01)
*F01K 23/12* (2006.01)

(58) Field of Classification Search
USPC ..... 60/651, 671, 676
See application file for complete search history.

(56) References Cited

U.S. PATENT DOCUMENTS 2,575,478 A 11/1951 Wilson
2,634,375 A 4/1953 Guimbal
2,691,280 A 10/1954 Albert
3,095,274 A 6/1963 Crawford
3,105,748 A 10/1963 Stahl
3,118,277 A 1/1964 Wormser
3,237,403 A 3/1966 Feher
3,277,955 A 10/1966 Laszlo
3,310,954 A 3/1967 Sijtstra et al.
3,401,277 A 9/1968 Larson
3,620,584 A 11/1971 Rosensweig
3,622,767 A 11/1971 Koepcke
3,630,022 A 12/1971 Jubb
3,736,745 A 6/1973 Karig
3,772,879 A 11/1973 Engdahl
3,791,137 A 2/1974 Jubb
3,828,610 A 8/1974 Swearingen
3,830,062 A 8/1974 Morgan et al.
3,831,381 A 8/1974 Swearingen
3,939,328 A 2/1976 Davis
3,971,211 A 7/1976 Wethe
3,977,197 A 8/1976 Brantley, Jr.
3,982,379 A 9/1976 Gilli
3,991,588 A 11/1976 Laskaris
3,998,058 A 12/1976 Park
4,003,786 A 1/1977 Cahn
4,005,580 A 2/1977 Swearingen
4,009,575 A 3/1977 Hartman, Jr.
4,015,962 A 4/1977 Tompkins
4,029,255 A 6/1977 Heiser
4,030,312 A 6/1977 Wallin
4,037,413 A 7/1977 Heller et al.
4,049,407 A 9/1977 Bottum
4,070,870 A 1/1978 Bahel
4,071,897 A 1/1978 Groves, Jr. et al.
4,089,744 A 5/1978 Cahn
4,099,381 A 7/1978 Rappoport
4,110,987 A 9/1978 Cahn et al.
4,119,140 A 10/1978 Cates
4,150,547 A 4/1979 Hobson
4,152,901 A 5/1979 Munters
4,164,848 A 8/1979 Gilli
4,164,849 A 8/1979 Mangus
4,170,435 A 10/1979 Swearingen
4,178,762 A 12/1979 Binstock et al.
4,182,960 A 1/1980 Reuyl
4,183,220 A 1/1980 Shaw
4,198,827 A 4/1980 Terry et al.
4,208,882 A 6/1980 Lopes
4,221,185 A 9/1980 Scholes
4,233,085 A 11/1980 Roderick
4,236,869 A 12/1980 Laurello
4,245,476 A 1/1981 Shaw
4,248,049 A 2/1981 Briley
4,257,232 A 3/1981 Bell
4,287,430 A 9/1981 Guido
4,336,692 A 6/1982 Ecker
4,347,711 A 9/1982 Noe
4,347,714 A 9/1982 Kinsell
4,364,239 A 12/1982 Chappelle et al.
4,372,125 A 2/1983 Dickenson
4,374,467 A 2/1983 Briley
4,384,568 A 5/1983 Palmatier
4,390,082 A 6/1983 Swearingen
4,391,101 A 7/1983 Labbe
4,420,947 A 12/1983 Yoshino
4,428,190 A 1/1984 Bronicki
4,433,554 A 2/1984 Rojey
4,439,687 A 3/1984 Wood
4,439,994 A 4/1984 Briley
4,445,180 A 4/1984 Davis
4,448,033 A 5/1984 Briccetti
4,450,363 A 5/1984 Russell
4,455,836 A 6/1984 Binstock
4,467,609 A 8/1984 Loomis
4,467,621 A 8/1984 O'Brien
4,471,622 A 9/1984 Kuwahara
4,475,353 A 10/1984 Lazare
4,489,562 A 12/1984 Snyder
4,489,563 A 12/1984 Kalina
4,498,289 A 2/1985 Osgerby
4,507,936 A 4/1985 Yoshino
4,516,403 A 5/1985 Tanaka
4,538,960 A 9/1985 Iino et al.
4,549,401 A 10/1985 Spliethoff
4,555,905 A 12/1985 Endou
4,558,228 A 12/1985 Larjola
4,573,321 A 3/1986 Knaebel
4,578,953 A 4/1986 Krieger
4,589,255 A 5/1986 Martens
4,636,578 A 1/1987 Feinberg
4,665,975 A 5/1987 Johnson
4,674,297 A 6/1987 Vobach
4,694,189 A 9/1987 Haraguchi
4,697,981 A 10/1987 Brown et al.
4,700,543 A 10/1987 Krieger
4,730,977 A 3/1988 Haaser
4,756,162 A 7/1988 Dayan
4,765,143 A 8/1988 Crawford
4,773,212 A 9/1988 Griffin
4,798,056 A 1/1989 Franklin
4,813,242 A 3/1989 Wicks
4,821,514 A 4/1989 Schmidt
4,867,633 A 9/1989 Gravelle
4,884,942 A 12/1989 Pennink
4,888,954 A 12/1989 Silvestri, Jr.
4,892,459 A 1/1990 Guelich
4,986,071 A 1/1991 Voss
4,993,483 A 2/1991 Harris
5,000,003 A 3/1991 Wicks
5,050,375 A 9/1991 Dickinson
5,080,047 A 1/1992 Williams et al.
5,083,425 A 1/1992 Hendriks et al.
5,098,194 A 3/1992 Kuo
5,102,295 A 4/1992 Pope
5,104,284 A 4/1992 Hustak, Jr.
5,164,020 A 11/1992 Wagner
5,176,321 A 1/1993 Doherty
5,203,159 A 4/1993 Koizumi et al.
5,228,310 A 7/1993 Vandenberg
5,248,239 A 9/1993 Andrews
5,291,509 A 3/1994 Mizoguchi et al.
5,291,960 A 3/1994 Brandenburg
5,320,482 A 6/1994 Palmer et al.
5,321,944 A 6/1994 Bronicki et al.
5,335,510 A 8/1994 Rockenfeller
5,358,378 A 10/1994 Holscher
5,360,057 A 11/1994 Rockenfeller

(56) References Cited

U.S. PATENT DOCUMENTS 5,384,489 A 1/1995 Bellac
5,392,606 A 2/1995 Labinov
5,440,882 A 8/1995 Kalina
5,444,972 A 8/1995 Moore
5,483,797 A 1/1996 Rigel et al.
5,487,822 A 1/1996 Demaray et al.
5,488,828 A 2/1996 Brossard
5,490,386 A 2/1996 Keller
5,503,222 A 4/1996 Dunne
5,526,646 A * 6/1996 Bronicki ..... F01D 15/10 60/641.2
5,531,073 A 7/1996 Bronicki
5,538,564 A 7/1996 Kaschmitter
5,542,203 A 8/1996 Luoma
5,544,479 A 8/1996 Yan et al.
5,570,578 A 11/1996 Saujet
5,588,298 A 12/1996 Kalina
5,600,967 A 2/1997 Meckler
5,609,465 A 3/1997 Batson et al.
5,634,340 A 6/1997 Grennan
5,647,221 A 7/1997 Garris, Jr.
5,649,426 A 7/1997 Kalina
5,676,382 A 10/1997 Dahlheimer
5,680,753 A 10/1997 Hollinger
5,685,152 A 11/1997 Sterling
5,704,206 A 1/1998 Kaneko et al.
5,738,164 A 4/1998 Hildebrand
5,754,613 A 5/1998 Hashiguchi
5,771,700 A 6/1998 Cochran
5,782,081 A 7/1998 Pak et al.
5,789,822 A 8/1998 Calistrat
5,799,490 A 9/1998 Bronicki et al.
5,813,215 A 9/1998 Weisser
5,833,876 A 11/1998 Schnur
5,862,666 A 1/1999 Liu
5,873,260 A 2/1999 Linhardt
5,874,039 A 2/1999 Edelson
5,884,470 A 3/1999 Frutschi
5,894,836 A 4/1999 Wu
5,899,067 A 5/1999 Hageman
5,901,783 A 5/1999 Dobak, III et al.
5,903,060 A 5/1999 Norton
5,918,460 A 7/1999 Connell
5,941,238 A 8/1999 Tracy
5,943,869 A 8/1999 Cheng
5,946,931 A 9/1999 Lomax
5,954,342 A 9/1999 Mikhalev et al.
5,973,050 A 10/1999 Johnson
6,037,683 A 3/2000 Lulay
6,041,604 A 3/2000 Nicodemus
6,058,695 A 5/2000 Ranasinghe
6,058,930 A 5/2000 Shingleton
6,059,450 A 5/2000 McClure
6,062,815 A 5/2000 Holt
6,065,280 A 5/2000 Ranasinghe
6,066,797 A 5/2000 Toyomura
6,070,405 A 6/2000 Jerye
6,082,110 A 7/2000 Rosenblatt
6,105,368 A 8/2000 Hansen
6,112,547 A 9/2000 Spauschus
6,129,507 A 10/2000 Ganelin
6,158,237 A 12/2000 Riffat
6,164,655 A 12/2000 Bothien
6,202,782 B1 3/2001 Hatanaka
6,223,846 B1 5/2001 Schechter
6,233,938 B1 5/2001 Nicodemus
6,233,955 B1 5/2001 Egara
6,282,900 B1 9/2001 Bell
6,282,917 B1 9/2001 Mongan
6,295,818 B1 10/2001 Ansley
6,298,653 B1 10/2001 Lawlor
6,299,690 B1 10/2001 Mongeon
6,341,781 B1 1/2002 Matz
6,347,520 B1 2/2002 Ranasinghe et al.
6,374,630 B1 4/2002 Jones
6,393,851 B1 5/2002 Wightman
6,432,320 B1 8/2002 Bonsignore
6,434,955 B1 8/2002 Ng
6,442,951 B1 9/2002 Maeda
6,446,425 B1 9/2002 Lawlor
6,446,465 B1 9/2002 Dubar
6,463,730 B1 10/2002 Keller
6,484,490 B1 11/2002 Olsen
6,490,812 B1 12/2002 Bennett et al.
6,530,224 B1 3/2003 Conchieri
6,539,720 B2 4/2003 Rouse et al.
6,539,728 B2 4/2003 Korin
6,563,855 B1 5/2003 Nishi et al.
6,571,548 B1 6/2003 Bronicki
6,581,384 B1 6/2003 Benson
6,588,499 B1 7/2003 Fahlsing
6,598,397 B2 7/2003 Hanna
6,644,062 B1 11/2003 Hays
6,657,849 B1 12/2003 Andresakis
6,668,554 B1 12/2003 Brown
6,684,625 B2 2/2004 Kline
6,695,974 B2 2/2004 Withers
6,715,294 B2 4/2004 Anderson
6,734,585 B2 5/2004 Tornquist
6,735,948 B1 5/2004 Kalina
6,739,142 B2 5/2004 Korin
6,751,959 B1 6/2004 McClanahan et al.
6,769,256 B1 8/2004 Kalina
6,799,892 B2 10/2004 Leuthold
6,808,179 B1 10/2004 Bhattacharyya
6,810,335 B2 10/2004 Lysaght
6,817,185 B2 11/2004 Coney
6,857,268 B2 2/2005 Stinger
6,892,522 B2 5/2005 Brasz et al.
6,910,334 B2 6/2005 Kalina
6,918,254 B2 7/2005 Baker
6,921,518 B2 7/2005 Johnston
6,941,757 B2 9/2005 Kalina
6,960,839 B2 11/2005 Zimron
6,960,840 B2 11/2005 Willis
6,962,054 B1 11/2005 Linney
6,962,056 B2 11/2005 Brasz et al.
6,964,168 B1 11/2005 Pierson
6,968,690 B2 11/2005 Kalina
6,986,251 B2 1/2006 Radcliff
7,013,205 B1 3/2006 Hafner et al.
7,021,060 B1 4/2006 Kalina
7,022,294 B2 4/2006 Johnston
7,033,553 B2 4/2006 Johnston
7,036,315 B2 5/2006 Kang
7,041,272 B2 5/2006 Keefer
7,047,744 B1 5/2006 Robertson
7,048,782 B1 5/2006 Couch
7,062,913 B2 6/2006 Christensen
7,096,665 B2 8/2006 Stinger
7,096,679 B2 8/2006 Manole
7,124,587 B1 10/2006 Linney
7,174,715 B2 2/2007 Armitage
7,194,863 B2 3/2007 Ganev
7,197,876 B1 4/2007 Kalina
7,200,996 B2 4/2007 Cogswell
7,234,314 B1 6/2007 Wiggs
7,249,588 B2 7/2007 Russell
7,278,267 B2 10/2007 Yamada
7,279,800 B2 10/2007 Bassett
7,287,381 B1 10/2007 Pierson
7,305,829 B2 12/2007 Mirolli
7,313,926 B2 1/2008 Gurin
7,340,894 B2 3/2008 Miyahara et al.
7,340,897 B2 3/2008 Zimron
7,343,746 B2 3/2008 Pierson
7,406,830 B2 8/2008 Valentian
7,416,137 B2 8/2008 Hagen et al.
7,453,242 B2 11/2008 Ichinose
7,458,217 B2 12/2008 Kalina
7,458,218 B2 12/2008 Kalina
7,464,551 B2 12/2008 Althaus et al.
7,469,542 B2 12/2008 Kalina
7,516,619 B2 4/2009 Pelletier

(56) References Cited

U.S. PATENT DOCUMENTS 7,600,394 B2 10/2009 Kalina
7,621,133 B2 11/2009 Tomlinson
7,654,354 B1 2/2010 Otterstrom
7,665,291 B2 2/2010 Anand
7,665,304 B2 2/2010 Sundel
7,673,681 B2 3/2010 Vinegar et al.
7,685,820 B2 3/2010 Litwin et al.
7,685,821 B2 3/2010 Kalina
7,730,713 B2 6/2010 Nakano
7,735,335 B2 6/2010 Uno
7,770,376 B1 8/2010 Brostmeyer
7,775,758 B2 8/2010 Legare
7,827,791 B2 11/2010 Pierson
7,838,470 B2 11/2010 Shaw
7,841,179 B2 11/2010 Kalina
7,841,306 B2 11/2010 Myers
7,854,587 B2 12/2010 Ito
7,866,157 B2 1/2011 Ernst
7,900,450 B2 3/2011 Gurin
7,950,230 B2 5/2011 Nishikawa
7,950,243 B2 5/2011 Gurin
7,971,424 B2 7/2011 Masada
7,972,529 B2 7/2011 Machado
7,997,076 B2 8/2011 Ernst
8,015,790 B2 9/2011 Zhang et al.
8,096,128 B2 1/2012 Held et al.
8,099,198 B2 1/2012 Gurin
8,099,972 B2 1/2012 Dupraz
8,146,360 B2 4/2012 Myers
8,235,647 B2 8/2012 Pisseloup et al.
8,281,593 B2 10/2012 Held
8,289,710 B2 10/2012 Spearing et al.
8,297,065 B2 10/2012 Vaisman et al.
8,375,719 B2 2/2013 Rhodes et al.
8,387,248 B2 3/2013 Rolt et al.
8,419,936 B2 4/2013 Berger et al.
8,544,274 B2 10/2013 Ernst
8,584,463 B2 11/2013 Hemrle et al.
8,613,195 B2 12/2013 Held et al.
8,661,820 B2 3/2014 Mak
8,813,497 B2 8/2014 Hart et al.
8,820,083 B2 9/2014 Davidson et al.
8,869,531 B2 10/2014 Held
8,973,398 B2 3/2015 Coyle
9,038,390 B1 5/2015 Kreuger
9,180,421 B2 11/2015 Kwang et al.
9,523,312 B2 12/2016 Allam et al.
9,638,065 B2 5/2017 Vermeersch et al.
9,810,451 B2 11/2017 O'Donnell et al.
9,845,667 B2 12/2017 Mokheimer et al.
9,874,112 B2 1/2018 Giegel
9,932,861 B2 4/2018 Preuss et al.
10,077,683 B2 9/2018 Close
10,400,636 B2 * 9/2019 Kim ..... F01K 13/006
2001/0015061 A1 8/2001 Viteri et al.
2001/0020444 A1 9/2001 Johnston
2001/0027642 A1 10/2001 Tsuji
2001/0030952 A1 10/2001 Roy
2002/0029558 A1 3/2002 Tamaro
2002/0053196 A1 5/2002 Lerner et al.
2002/0066270 A1 6/2002 Rouse et al.
2002/0078696 A1 6/2002 Korin
2002/0078697 A1 6/2002 Lifson
2002/0082747 A1 6/2002 Kramer
2002/0148225 A1 10/2002 Lewis
2003/0000213 A1 1/2003 Christensen
2003/0061823 A1 4/2003 Alden
2003/0154718 A1 8/2003 Nayar
2003/0182946 A1 10/2003 Sami
2003/0213246 A1 11/2003 Coll et al.
2003/0221438 A1 12/2003 Rane et al.
2004/0011038 A1 1/2004 Stinger
2004/0011039 A1 1/2004 Stinger et al.
2004/0020185 A1 2/2004 Brouillette et al.
2004/0020206 A1 2/2004 Sullivan et al.
2004/0021182 A1 2/2004 Green et al.
2004/0035117 A1 2/2004 Rosen
2004/0083731 A1 5/2004 Lasker
2004/0083732 A1 5/2004 Hanna et al.
2004/0088992 A1 5/2004 Brasz et al.
2004/0097388 A1 5/2004 Brask et al.
2004/0105980 A1 6/2004 Sudarshan et al.
2004/0107700 A1 6/2004 McClanahan et al.
2004/0159110 A1 8/2004 Janssen
2004/0211182 A1 10/2004 Gould
2004/0247211 A1 12/2004 Hamke
2005/0022963 A1 2/2005 Garrabrant et al.
2005/0056001 A1 3/2005 Frutschi
2005/0072182 A1 4/2005 Taniguchi et al.
2005/0096676 A1 5/2005 Gifford, III et al.
2005/0109387 A1 5/2005 Marshall
2005/0118025 A1 6/2005 Hiegemann et al.
2005/0137777 A1 6/2005 Kolavennu et al.
2005/0162018 A1 7/2005 Realmuto et al.
2005/0167169 A1 8/2005 Gering et al.
2005/0183421 A1 8/2005 Vaynberg et al.
2005/0196676 A1 9/2005 Singh et al.
2005/0198959 A1 9/2005 Schubert
2005/0227187 A1 10/2005 Schilling
2005/0252235 A1 11/2005 Critoph et al.
2005/0257812 A1 11/2005 Wright et al.
2005/0262848 A1 12/2005 Joshi et al.
2005/0276685 A1 12/2005 Wiggins et al.
2006/0010868 A1 1/2006 Smith
2006/0060333 A1 3/2006 Chordia et al.
2006/0066113 A1 3/2006 Ebrahim et al.
2006/0080960 A1 4/2006 Rajendran et al.
2006/0112693 A1 6/2006 Sundel
2006/0112702 A1 6/2006 Martin et al.
2006/0182680 A1 8/2006 Keefer et al.
2006/0211871 A1 9/2006 Dai et al.
2006/0213218 A1 9/2006 Uno et al.
2006/0222523 A1 10/2006 Valentian et al.
2006/0225421 A1 10/2006 Yamanaka et al.
2006/0225459 A1 10/2006 Meyer
2006/0249020 A1 11/2006 Tonkovich et al.
2006/0254281 A1 11/2006 Badeer et al.
2007/0001766 A1 1/2007 Ripley et al.
2007/0007771 A1 1/2007 Biddle et al.
2007/0017192 A1 1/2007 Bednarek et al.
2007/0019708 A1 1/2007 Shiflett et al.
2007/0027038 A1 2/2007 Kamimura et al.
2007/0056290 A1 3/2007 Dahm
2007/0089449 A1 4/2007 Gurin
2007/0101732 A1 * 5/2007 Mak ..... F25J 3/0242
62/50.3
2007/0108200 A1 5/2007 McKinzie, II
2007/0119175 A1 5/2007 Ruggieri et al.
2007/0130952 A1 6/2007 Copen
2007/0151244 A1 7/2007 Gurin
2007/0161095 A1 7/2007 Gurin
2007/0163261 A1 7/2007 Strathman
2007/0195152 A1 8/2007 Kawai et al.
2007/0204620 A1 9/2007 Pronske et al.
2007/0227472 A1 10/2007 Takeuchi et al.
2007/0234722 A1 10/2007 Kalina
2007/0245733 A1 10/2007 Pierson et al.
2007/0246206 A1 10/2007 Gong et al.
2008/0000225 A1 1/2008 Kalina
2008/0006040 A1 1/2008 Peterson et al.
2008/0010967 A1 1/2008 Griffin et al.
2008/0023666 A1 1/2008 Gurin
2008/0053095 A1 3/2008 Kalina
2008/0066470 A1 3/2008 MacKnight
2008/0134681 A1 6/2008 Nayef et al.
2008/0135253 A1 6/2008 Vinegar et al.
2008/0163618 A1 7/2008 Paul
2008/0163625 A1 7/2008 O'Brien
2008/0173444 A1 7/2008 Stone et al.
2008/0173450 A1 7/2008 Goldberg et al.
2008/0174115 A1 7/2008 Lambirth
2008/0211230 A1 9/2008 Gurin
2008/0217321 A1 9/2008 Vinegar et al.
2008/0250789 A1 10/2008 Myers et al.

(56) References Cited

U.S. PATENT DOCUMENTS

2008/0252078 A1 10/2008 Myers
2008/0282702 A1 11/2008 Collins
2008/0282715 A1 11/2008 Aue et al.
2009/0021251 A1 1/2009 Simon
2009/0071156 A1 3/2009 Nishikawa et al.
2009/0085709 A1 4/2009 Meinke
2009/0107144 A1 4/2009 Moghtaderi et al.
2009/0139234 A1 6/2009 Gurin
2009/0139781 A1 6/2009 Straubel
2009/0173337 A1 7/2009 Tamaura et al.
2009/0173486 A1 7/2009 Copeland
2009/0179429 A1 7/2009 Ellis et al.
2009/0180903 A1 7/2009 Martin et al.
2009/0205892 A1 8/2009 Jensen et al.
2009/0211251 A1 8/2009 Peterson et al.
2009/0211253 A1 8/2009 Radcliff et al.
2009/0257902 A1 10/2009 Ernens
2009/0266075 A1 10/2009 Westmeier et al.
2009/0293503 A1 12/2009 Vandor
2009/0320477 A1 12/2009 Juchymenko
2010/0024421 A1 2/2010 Litwin
2010/0077792 A1 4/2010 Gurin
2010/0083662 A1 4/2010 Kalina
2010/0102008 A1 4/2010 Hedberg
2010/0122533 A1 5/2010 Kalina
2010/0143094 A1 6/2010 Pisseloup et al.
2010/0146949 A1 6/2010 Stobart et al.
2010/0146973 A1 6/2010 Kalina
2010/0156112 A1 6/2010 Held et al.
2010/0162721 A1 7/2010 Welch et al.
2010/0205962 A1 8/2010 Kalina
2010/0212316 A1 8/2010 Waterstripe et al.
2010/0218513 A1 9/2010 Vaisman et al.
2010/0218930 A1 9/2010 Proeschel
2010/0263380 A1 10/2010 Biederman et al.
2010/0287920 A1 11/2010 Duparchy
2010/0287934 A1 11/2010 Glynn et al.
2010/0300093 A1 12/2010 Doty
2010/0319346 A1 12/2010 Ast et al.
2010/0326076 A1 12/2010 Ast et al.
2011/0027064 A1 2/2011 Pal et al.
2011/0030404 A1 2/2011 Gurin
2011/0048012 A1 3/2011 Ernst et al.
2011/0051880 A1 3/2011 Al-Mayahi et al.
2011/0061384 A1 3/2011 Held et al.
2011/0061387 A1 3/2011 Held et al.
2011/0088399 A1 4/2011 Briesch et al.
2011/0100002 A1 5/2011 Muir et al.
2011/0100611 A1 5/2011 Ohler et al.
2011/0113781 A1 5/2011 Frey et al.
2011/0164957 A1 7/2011 Rivas et al.
2011/0179799 A1 7/2011 Allam et al.
2011/0185729 A1 8/2011 Held
2011/0192163 A1 8/2011 Kasuya
2011/0203278 A1 8/2011 Kopecek et al.
2011/0214424 A1 9/2011 Wood
2011/0219760 A1 9/2011 McBride et al.
2011/0259010 A1 10/2011 Bronicki et al.
2011/0270451 A1 11/2011 Sakaguchi et al.
2011/0286724 A1 11/2011 Goodman
2011/0288688 A1 11/2011 Lehan
2011/0299972 A1 12/2011 Morris
2011/0308253 A1 12/2011 Ritter
2012/0042650 A1 2/2012 Ernst et al.
2012/0027688 A1 3/2012 Yin et al.
2012/0047892 A1 3/2012 Held et al.
2012/0055153 A1 3/2012 Murata et al.
2012/0067046 A1 3/2012 Drenik et al.
2012/0067055 A1 3/2012 Held
2012/0111003 A1 5/2012 Kasuya et al.
2012/0125002 A1 5/2012 Lehar et al.
2012/0128463 A1 5/2012 Held
2012/0131918 A1 5/2012 Held
2012/0131919 A1 5/2012 Held
2012/0131920 A1 5/2012 Held
2012/0131921 A1 5/2012 Held
2012/0159922 A1 6/2012 Gurin
2012/0159956 A1 6/2012 Gurin
2012/0167873 A1 7/2012 Venetos et al.
2012/0174558 A1 7/2012 Gurin
2012/0186219 A1 7/2012 Gurin
2012/0240616 A1 9/2012 Ritter et al.
2012/0247134 A1 10/2012 Gurin
2012/0247455 A1 10/2012 Gurin et al.
2012/0255304 A1 10/2012 Li et al.
2012/0261090 A1 10/2012 Durmaz et al.
2012/0261104 A1 10/2012 Kelly et al.
2012/0306206 A1 12/2012 Agrawal et al.
2012/0319410 A1 12/2012 Ambrosek et al.
2013/0019597 A1 1/2013 Kalina
2013/0033037 A1 2/2013 Held et al.
2013/0036736 A1 2/2013 Hart et al.
2013/0074497 A1 3/2013 Mori et al.
2013/0087301 A1 4/2013 Hemrle et al.
2013/0113221 A1 5/2013 Held
2013/0134720 A1 5/2013 Fukasaku et al.
2013/0145759 A1 6/2013 Sonwane et al.
2014/0041387 A1 2/2014 Benson
2014/0090405 A1 4/2014 Held et al.
2014/0102098 A1 4/2014 Bowan et al.
2014/0102101 A1* 4/2014 Xie ..... F01K 25/103 60/647
2014/0102103 A1 4/2014 Yamamoto et al.
2014/0150992 A1 6/2014 Koontz et al.
2014/0208750 A1 7/2014 Vermeersch
2014/0208751 A1 7/2014 Bowan
2014/0216034 A1 8/2014 Numata et al.
2014/0223907 A1 8/2014 Fujioka et al.
2014/0224447 A1 8/2014 Reznik et al.
2015/0069758 A1 3/2015 Davidson et al.
2015/0369086 A1 12/2015 Johnson et al.
2016/0017759 A1 1/2016 Gayawal et al.
2016/0040557 A1 2/2016 Vermeersch et al.
2016/0102608 A1 4/2016 Lynn
2016/0237904 A1 8/2016 Scarboro et al.
2017/0058202 A1 3/2017 Noureldin et al.
2017/0350658 A1 12/2017 Kerth et al.
2017/0362963 A1 12/2017 Hostler et al.
2018/0187628 A1 7/2018 Apte
2018/0340712 A1 11/2018 Peter et al.
2019/0170026 A1 6/2019 Matsukuma et al.
2020/0003081 A1 1/2020 Held

FOREIGN PATENT DOCUMENTS

CN 1432102 A 7/2003
CN 101614139 A 12/2009
CN 202055876 U 11/2011
CN 202544943 U 11/2012
CN 202718721 U 2/2013
DE 2632777 A1 2/1977
DE 19906087 A1 8/2000
DE 10052993 A1 5/2002
DE 102007020086 B3 4/2007
DE 10 2011005722 B3 3/2011
EP 0003980 A1 2/1979
EP 0286565 A2 4/1988
EP 1484489 A2 8/2004
EP 1577549 A1 9/2005
EP 1977174 A2 10/2008
EP 1998013 A2 12/2008
EP 2157317 A2 2/2010
EP 2241737 A1 10/2010
EP 2312129 A1 4/2011
EP 2357324 A2 9/2011
EP 2390473 A1 11/2011
EP 2419621 A1 2/2012
EP 2446122 A1 5/2012
EP 2478201 A1 7/2012
EP 2500530 A1 9/2012
EP 2550436 A1 1/2013
EP 2698506 A1 2/2014
GB 856985 A 12/1960
GB 2010974 A 7/1979

(56) References Cited

FOREIGN PATENT DOCUMENTS

| | | | |
|---|---|---|---|
| GB | 2075608 | A | 11/1981 |
| JP | 58-193051 | A | 11/1983 |
| JP | 60-040707 | A | 3/1985 |
| JP | 61-152914 | A | 7/1986 |
| JP | 01-240705 | A | 9/1989 |
| JP | H03182638 | A | 8/1991 |
| JP | 05-321612 | A | 12/1993 |
| JP | 05-321648 | A | 12/1993 |
| JP | 06-331225 | A | 11/1994 |
| JP | 08-028805 | A | 2/1996 |
| JP | 09-100702 | A | 4/1997 |
| JP | 2641581 | B2 | 5/1997 |
| JP | 09-209716 | A | 8/1997 |
| JP | 2858750 | B2 | 12/1998 |
| JP | H11-270352 | | 5/1999 |
| JP | 2000-257407 | A | 9/2000 |
| JP | 3119718 | B2 | 12/2000 |
| JP | 2001-193419 | A | 7/2001 |
| JP | 2002-097965 | A | 4/2002 |
| JP | 2003-529715 | A | 10/2003 |
| JP | 2004-239250 | A | 8/2004 |
| JP | 2004-332626 | A | 11/2004 |
| JP | 2005-030727 | A | 2/2005 |
| JP | 2005-533972 | A1 | 11/2005 |
| JP | 2006-037760 | A | 2/2006 |
| JP | 2006-177266 | A | 7/2006 |
| JP | 2007-198200 | A | 9/2007 |
| JP | 4343738 | B2 | 10/2009 |
| JP | 2011-017268 | A | 1/2011 |
| KR | 100191080 | | 6/1999 |
| KR | 10_2007_0086244 | A | 8/2007 |
| KR | 10-0766101 | B1 | 10/2007 |
| KR | 10-0844634 | A | 7/2008 |
| KR | 10-20100067927 | A | 6/2010 |
| KR | 1020110018769 | A | 2/2011 |
| KR | 1069914 | B1 | 9/2011 |
| KR | 1103549 | B1 | 1/2012 |
| KR | 10-2012-0058582 | A | 6/2012 |
| KR | 2012-0068670 | A | 6/2012 |
| KR | 2012-0128753 | A | 11/2012 |
| KR | 2012-0128755 | A | 11/2012 |
| WO | WO 1991/05145 | A1 | 4/1991 |
| WO | WO 92/12366 | A1 | 7/1992 |
| WO | WO 1996/009500 | A1 | 3/1996 |
| WO | WO 00-71944 | A1 | 11/2000 |
| WO | WO 2001/044658 | A1 | 6/2001 |
| WO | WO 02/090721 | A1 | 11/2002 |
| WO | WO 02/090747 | A2 | 11/2002 |
| WO | WO 2006/060253 | | 6/2006 |
| WO | WO 2006/137957 | A1 | 12/2006 |
| WO | WO 2007/056241 | A2 | 5/2007 |
| WO | WO 2007/079245 | A2 | 7/2007 |
| WO | WO 2007/082103 | A2 | 7/2007 |
| WO | WO 2007/112090 | A2 | 10/2007 |
| WO | WO 2007/116299 | | 10/2007 |
| WO | WO 2008014774 | A2 | 2/2008 |
| WO | WO 2008/039725 | A2 | 4/2008 |
| WO | WO 2008/101711 | A2 | 8/2008 |
| WO | WO 2009/045196 | A1 | 4/2009 |
| WO | WO 2009/058992 | A2 | 5/2009 |
| WO | WO 2010/006942 | A1 | 2/2010 |
| WO | WO 2010/017981 | A2 | 2/2010 |
| WO | WO 2010/017981 | A3 | 2/2010 |
| WO | WO 2010/074173 | A1 | 7/2010 |
| WO | WO 2010/083198 | A1 | 7/2010 |
| WO | WO 2010/121255 | A1 | 10/2010 |
| WO | WO 2010/126980 | A2 | 11/2010 |
| WO | WO 2010/151560 | A1 | 12/2010 |
| WO | WO 2011/017450 | A2 | 2/2011 |
| WO | WO 2011/017476 | A1 | 2/2011 |
| WO | WO 2011/017599 | A1 | 2/2011 |
| WO | WO 2011/034984 | A1 | 3/2011 |
| WO | WO 2011/094294 | A2 | 8/2011 |
| WO | WO 2011/119650 | A2 | 9/2011 |
| WO | WO 2012/036678 | A1 | 3/2012 |
| WO | WO 2012/047889 | | 4/2012 |
| WO | WO 2012/074905 | A2 | 6/2012 |
| WO | WO 2012/074907 | A2 | 6/2012 |
| WO | WO 2012/074911 | A2 | 6/2012 |
| WO | WO 2012/074940 | A2 | 6/2012 |
| WO | WO 2013/055391 | A1 | 4/2013 |
| WO | WO 2013/059687 | A1 | 4/2013 |
| WO | WO 2013/059695 | A1 | 4/2013 |
| WO | WO 2013/070249 | A1 | 5/2013 |
| WO | WO 2013/074907 | A1 | 5/2013 |
| WO | WO 2014/164620 | A1 | 3/2014 |
| WO | WO 2014/114531 | A1 | 7/2014 |
| WO | WO 2014/138035 | A1 | 9/2014 |
| WO | WO 2014/159520 | A1 | 10/2014 |
| WO | WO 2016/150455 | A1 | 9/2016 |
| WO | WO 2018/217969 | A1 | 11/2018 |
| WO | WO 2020/90721 | A1 | 7/2020 |

OTHER PUBLICATIONS

Angelino, G., and Invernizzi, C.M., "Carbon Dioxide Power Cycles using Liquid Natural Gas as Heat Sink", Applied Thermal Engineering Mar. 3, 2009, 43 pages.

Bryant, John C., Saari, Henry, and Zanganeh, Kourosh, "An Analysis and Comparison of the Simple and Recompression Supercritical CO2 Cycles" Supercritical CO2 Power Cycle Symposium, May 24-25, 2011, Boulder, CO, 8 pages.

Chapman, Daniel J., Arias, Diego A., "An Assessment of the Supercritical Carbon Dioxide Cycle for Use in a Solar Parabolic Trough Power Plant", Presentation, Abengoa Solar, Apr. 29-30, 2009, Troy, NY, 20 pages.

Chapman, Daniel J., Arias, Diego A., "An Assessment of the Supercritical Carbon Dioxide Cycle for Use in a Solar Parabolic Trough Power Plant", Paper, Abengoa Solar, Apr. 29-30, 2009, Troy, NY, 5 pages.

Chen, Yang, Lundqvist, P., Johansson, A., Platell, P., "A Comparative Study of the Carbon Dioxide Transcritical Power Cycle Compared with an Organic Rankine Cycle with R123 as Working Fluid in Waste Heat Recovery", Science Direct, Applied Thermal Engineering, Jun. 12, 2006, 6 pages.

Chen, Yang, "Thermodynamic Cycles Using Carbon Dioxide as Working Fluid", Doctoral Thesis, School of Industrial Engineering and Management, Stockholm, Oct. 2011, 150 pages., (3 parts).

Chinese Search Report for Application No. 201080035382.1, 2 pages.

Chinese Search Report for Application No. 201080050795.7, 2 pages.

Chordia, Lalit, "Optimizing Equipment for Supercritical Applications", Thar Energy LLC, Supercritical CO2 Power Cycle Symposium, May 24-25, 2011, Boulder, CO, 7 pages.

Colegrove, et al., "Structured Steam Turbines for the Combined-Cycle Market", GE Power Systems, GER-4201, May 2001, 18 pages.

Combs, Osie V., "An Investigation of the Supercritical CO2 Cycle (Feher cycle) for Shipboard Application", Massachusetts Institute of Technology, May 1977, 290 pages.

Di Bella, Francis A., "Gas Turbine Engine Exhaust Waste Heat Recovery Navy Shipboard Module Development", Supercritical CO2 Power Cycle Symposium, May 24-25, 2011, Boulder, CO, 8 pages.

Dostal, V., et al., A Supercritical Carbon Dioxide Cycle for Next Generation Nuclear Reactors, Mar. 10, 2004, 326 pages., (7 parts).

Dostal, Vaclav and Kulhanek, Martin, "Research on the Supercritical Carbon Dioxide Cycles in the Czech Republic", Czech Technical University in Prague, Symposium on SCO2 Power Cycles, Apr. 29-30, 2009, Troy, NY, 8 pages.

Dostal, Vaclav, and Dostal, Jan, "Supercritical CO2 Regeneration Bypass Cycle—Comparison to Traditional Layouts", Supercritical CO2 Power Cycle Symposium, May 24-25, 2011, Boulder, CO, 5 pages.

Ebenezer, Salako A.; "Removal of Carbon Dioxide from Natural Gas for LNG Production", Institute of Petroleum Technology Norwegian University of Science and Technology, Dec. 2005, Trondheim, Norway, 74 pages.

(56) References Cited

OTHER PUBLICATIONS

Eisemann, Kevin, and Fuller, Robert L., "Supercritical CO2 Brayton Cycle Design and System Start-up Options", Barber Nichols, Inc., Paper, Supercritical CO2 Power Cycle Symposium, May 24-25, 2011, Boulder, CO, 7 pages.
Eisemann, Kevin, and Fuller, Robert L., "Supercritical CO2 Brayton Cycle Design and System Start-up Options", Presentation, Supercritical CO2 Power Cycle Symposium, May 24-25, 2011, Boulder, CO, 11 pages.
Feher, E.G., et al., "Investigation of Supercritical (Feher) Cycle", Astropower Laboratory, Missile & Space Systems Division, Oct. 1968, 152 pages.
Fuller, Robert L., and Eisemann, Kevin, "Centrifugal Compressor Off-Design Performance for Super-Critical CO2" , Barber Nichols, Inc. Presentation, Supercritical CO2 Power Cycle Symposium, May 24-25, 2011, Boulder, CO, 20 pages.
Fuller, Robert L., and Eisemann, Kevin, "Centrifugal Compressor Off-Design Performance for Super-Critical CO2", Paper, Supercritical CO2 Power Cycle Symposium, May 24-25, 2011, Boulder, CO, 12 pages.
Gokhstein, D.P. and Verkhivker, G.P. "Use of Carbon Dioxide as a Heat Carrier and Working Substance in Atomic Power Stations", Soviet Atomic Energy, Apr. 1969, vol. 26, Issue 4, pp. 430-432.
Gokhstein, D.P.; Taubman, E.I.; Konyaeva, G.P., "Thermodynamic Cycles of Carbon Dioxide Plant with an Additional Turbine After the Regenerator", Energy Citations Database, Mar. 1973, 1 Page, Abstract only.
Gowrishankar, K., "Adaptive Fuzzy Controller to Control Turbine Speed", Rajiv Gandhi College of Engg. & tech., Puducherry, India, 7 pages.
Hjartarson, Heimir; "Waste Heat Utilization at Elkem Ferrosilicon Plant in Iceland", University of Iceland, 2009, 102 pages.
Hjartarson, et al.; "Waste Heat Utilization from a Submerged ARC Furnace Producing Ferrosilicon", The Twelfth International Ferroalloys Congress Sustainable Future; , Helsinki, Finland ,Jun. 6-9, 2010, 10 pages.
Hejzlar, P. et al., "Assessment of Gas Cooled Gas Reactor with Indirect Supercritical CO2 Cycle" Massachusetts Institute of Technology, Jan. 2006, 10 pages.
Hoffman, John R., and Feher, E.G., "150 kwe Supercritical Closed Cycle System", Transactions of the ASME, Jan. 1971, pp. 70-80.
Jeong, Woo Seok, et al., "Performance of S-CO2 Brayton Cycle with Additive Gases for SFR Application", Korea Advanced Institute of Science and Technology, Supercritical CO2 Power Cycle Symposium, May 24-25, 2011, Boulder, CO, 5 pages.
Johnson, Gregory A., & McDowell, Michael, "Issues Associated with Coupling Supercritical CO2 Power Cycles to Nuclear, Solar and Fossil Fuel Heat Sources", Hamilton Sundstrand, Energy Space & Defense-Rocketdyne, Apr. 29-30, 2009, Troy, NY, Presentation, 18 pages.
Kawakubo, Tomoki, "Unsteady Roto-Stator Interaction of a Radial-Inflow Turbine with Variable Nozzle Vanes", ASME Turbo Expo 2010: Power for Land, Sea, and Air; vol. 7: Turbomachinery, Parts A, B, and C; Glasgow, UK, Jun. 14-18, 2010, Paper No. GT2010-23677, pp. 2075-2084, (1 page, Abstract only).
Kulhanek, Martin, "Thermodynamic Analysis and Comparison of S-CO2 Cycles", Presentation, Czech Technical University in Prague, Supercritical CO2 Power Cycle Symposium, May 24-25, 2011, Boulder, CO, 14 pages.
Kulhanek, Martin, "Thermodynamic Analysis and Comparison of S-CO2 Cycles", Paper, Czech Technical University in Prague, Supercritical CO2 Power Cycle Symposium, May 24-25, 2011, Boulder, CO, 7 pages.
Kulhanek, Martin., and Dostal, Vaclav, "Supercritical Carbon Dioxide Cycles Thermodynamic Analysis and Comparison", Abstract, Faculty Conference held in Prague, Mar. 24, 2009, 13 pages.
Ma, Zhiwen and Turchi, Craig S., "Advanced Supercritical Carbon Dioxide Power Cycle Configurations for Use in Concentrating Solar Power Systems", National Renewable Energy Laboratory, Supercritical CO2 Power Cycle Symposium, May 24-25, 2011, Boulder, CO, 4 pages.
Mohamed, Omar, et al., "Modelling Study of Supercritical Power Plant and Parameter Identified Using Genetic Algorithms", Proceedings of the World Congress on Engineering 2010 vol. II, WCE 2010, Jun. 30-Jul. 2, 2010, London, U.K., 6 pages.
Moisseytsev, Anton, and Sienicki, Jim, "Investigation of Alternative Layouts for the Supercritical Carbon Dioxide Brayton Cycle for a Sodium-Cooled Fast Reactor", Supercritical CO2 Power Cycle Symposium, Troy, NY, Apr. 29, 2009, 26 pages.
Munoz De Escalona, Jose M., "The Potential of the Supercritical Carbon Dioxide Cycle in High Temperature Fuel Cell Hybrid Systems", Paper, Thermal Power Group, University of Seville, Supercritical CO2 Power Cycle Symposium, May 24-25, 2011, Boulder, CO, 6 pages.
Munoz De Escalona, Jose M., et al., "The Potential of the Supercritical Carbon Dioxide Cycle in High Temperature Fuel Cell Hybrid Systems", Presentation, Thermal Power Group, University of Seville, Supercritical CO2 Power Cycle Symposium, May 24-25, 2011, Boulder, CO, 19 pages.
Muto, Y., et al., "Application of Supercritical CO2 Gas Turbine for the Fossil Fired Thermal Plant", Journal of Energy and Power Engineering, Sep. 30, 2010, vol. 4, No. 9, 9 pages.
Muto, Yasushi, and Kato, Yasuyoshi, "Optimal Cycle Scheme of Direct Cycle Supercritical CO2 Gas Turbine for Nuclear Power Generation Systems", International Conference on Power Engineering-2007, Oct. 23-27, 2007, Hangzhou, China, pp. 86-87.
Noriega, Bahamonde J.S., "Design Method for s-CO2 Gas Turbine Power Plants", Master of Science Thesis, Delft University of Technology, Oct. 2012, 122 pages., (3 parts).
Oh, Chang, et al., "Development of a Supercritical Carbon Dioxide Brayton Cycle: Improving PBR Efficiency and Testing Material Compatibility", Presentation, Nuclear Energy Research Initiative Report, Oct. 2004, 38 pages.
Oh, Chang; et al., "Development of a Supercritical Carbon Dioxide Brayton Cycle: Improving VHTR Efficiency and Testing Material Compatibility", Presentation, Nuclear Energy Research Initiative Report, Final Report, Mar. 2006, 97 pages.
Parma, Ed, et al., "Supercritical CO2 Direct Cycle Gas Fast Reactor (SC-GFR) Concept" Presentation for Supercritical CO2 Power Cycle Symposium, May 24-25, 2011, Boulder, CO, 40 pages.
Parma, Ed, et al., "Supercritical CO2 Direct Cycle Gas Fast Reactor (SC-GFR) Concept", Supercritical CO2 Power Cycle Symposium, May 24-25, 2011, Boulder, CO, 9 pages.
Parma, Edward J., et al., "Supercritical CO2 Direct Cycle Gas Fast Reactor (SC-GFR) Concept", Presentation, Sandia National Laboratories, May 2011, 55 pages.
PCT/US2011/029486—International Preliminary Report on Patentability dated Sep. 25, 2012, 6 pages.
PCT/US2011/029486—International Search Report and Written Opinion dated Nov. 16, 2011, 9 pages.
PCT/US2010/049042—International Search Report and Written Opinion dated Nov. 17, 2010, 11 pages.
PCT/US2010/049042—International Preliminary Report on Patentability dated Mar. 29, 2012, 18 pages.
PCT/US2010/031614—International Search Report dated Jul. 12, 2010, 3 pages.
PCT/US2010/031614—International Preliminary Report on Patentability dated Oct. 27, 2011, 9 pages.
PCT/US2010/039559—International Preliminary Report on Patentability dated Jan. 12, 2012, 7 pages.
PCT/US2010/039559—Notification of Transmittal of the International Search Report and Written Opinion of the International Searching Authority, or the Declaration dated Sep. 1, 2010, 6 pages.
PCT/US2010/044681—International Search Report and Written Opinion dated Oct. 7, 2010, 10 pages.
PCT/US2010/044681—International Preliminary Report on Patentability dated Feb. 16, 2012, 9 pages.
PCT/US2010/044476—International Search Report dated Sep. 29, 2010, 23 pages.
PCT/US2007/001120—International Search Report dated Apr. 25, 2008, 7 pages.

(56) References Cited

OTHER PUBLICATIONS

PCT/US2006/049623—Written Opinion of ISA dated Jan. 4, 2008, 4 pages.
PCT/US2007/079318—International Preliminary Report on Patentability dated Jul. 7, 2008, 5 pages.
PCT/US2013/055547—Notification of Transmittal of the International Search Report and the Written Opinion of the International Searching Authority, or the Declaration dated Jan. 24, 2014, 11 pages.
PCT/US2013/064470—Notification of Transmittal of the International Search Report and the Written Opinion of the International Searching Authority, or the Declaration dated Jan. 22, 2014, 10 pages.
PCT/US2013/064471—Notification of Transmittal of the International Search Report and the Written Opinion of the International Searching Authority, or the Declaration dated Jan. 24, 2014, 10 pages.
PCT/US2014/023026—Notification of Transmittal of the International Search Report and the Written Opinion of the International Searching Authority, or the Declaration dated Jul. 22, 2014, 11 pages.
PCT/US2014/013170—Notification of Transmittal of the International Search Report and the Written Opinion of the International Searching Authority, or the Declaration dated May 9, 2014, 12 pages.
PCT/US2011/062266—International Search Report and Written Opinion dated Jul. 9, 2012, 12 pages.
PCT/US2011/062198—International Search Report and Written Opinion dated Jul. 2, 2012, 9 pages.
PCT/US2011/062198—Extended European Search Report dated May 6, 2014, 9 pages.
PCT/US2011/062201—International Search Report and Written Opinion dated Jun. 26, 2012, 9 pages.
PCT/US2011/062201—Extended European Search Report dated May 28, 2014, 8 pages.
PCT/US2011/062204—International Search Report dated Nov. 1, 2012, 10 pages.
PCT/US2011/62207—International Search Report and Written Opinion dated Jun. 28, 2012, 7 pages.
PCT/US2014/013154—International Search Report dated May 23, 2014, 4 pages.
PCT/US2014/024548—International Search Report and Written Opinion dated Sep. 5, 2014, 11 pages.
PCT/US2013/064475—International Search Report and Written Opinion dated Jan. 16, 2014, 11 pages.
PCT/US2014/024254—International Search Report and Written Opinion dated Aug. 13, 2014, 10 pages.
PCT/US2014/026173—Notification of Transmittal of the International Search Report and the Written Opinion of the International Searching Authority, or the Declaration dated Jul. 9, 2014, 10 pages.
PCT/US2012/000470—International Search Report dated Mar. 8, 2013, 10 pages.
PCT/US2012/061151—International Search Report and Written Opinion dated Feb. 25, 2013, 9 pages.
PCT/US2012/061159—International Search Report dated Mar. 2, 2013, 10 pages.
PCT/US2014/024305—Notification of Transmittal of the International Search Report and the Written Opinion of the International Searching Authority, or the Declaration dated Aug. 26, 2014, 11 pages.
PCT/US2014/023990—Notification of Transmittal of the International Search Report and the Written Opinion of the International Searching Authority, or the Declaration dated Jul. 17, 2014, 10 pages.
PCT/US2015/57701—Notification of Transmittal of the International Search Report and the Written Opinion of the International Searching Authority, or the Declaration dated Dec. 22, 2015, 11 pages.
PCT/US2015/57756—Notification of Transmittal of the International Search Report and the Written Opinion of the International Searching Authority, or the Declaration dated Jul. 27, 2017, 41 pages.
PCT/US2014/020242—Notification of Transmittal of the International Search Report and the Written Opinion of the International Searching Authority, or the Declaration dated Aug. 5, 2014, 9 pages.
PCT/US2018/034289—Notification of Transmittal of the International Search Report and the Written Opinion of the International Searching Authority, or the Declaration dated Oct. 2, 2018, 22 pages.
"Steam Turbines", PDHengineer.com Course Nº M-3006.
Steam Turbines (Energy Engineering) http://what-when-how.com/energy-engineering/steam-turbines-energy-engineering/, Oct. 25, 2012, 14 pages.
Persichilli, Michael, et al., "Supercritical CO2 Power Cycle Developments and Commercialization: Why sCO2 can Displace Steam" Echogen Power Systems LLC, Power-Gen India & Central Asia 2012, Apr. 19-21, 2012, New Delhi, India, 15 pages.
Pruess, Karsten, "Enhanced Geothermal Systems (EGS): Comparing Water and CO2 as Heat Transmission Fluids", Proceedings, New Zealand Geothermal Workshop 2007 Auckland, New Zealand, Nov. 19-21, 2007, 13 pages.
Pruess, Karsten, "Enhanced Geothermal Systems (EGS): Using CO2 as Working Fluid—A Novel Approach for Generating Renewable Energy with Simultaneous Sequestration of Carbon", Submitted to Geothermics, Jun. 2006, 26 pages.
Renz, Manfred, "The New Generation Kalina Cycle", Contribution to the Conference: "Electricity Generation from Enhanced Geothermal Systems", Sep. 14, 2006, Strasbourg, France, 18 pages.
Saari, Henry, et al., "Supercritical CO2 Advanced Brayton Cycle Design", Presentation, Carleton University, Supercritical CO2 Power Cycle Symposium, May 24-25, 2011, Boulder, CO, 21 pages.
San Andres, Luis, "Start-Up Response of Fluid Film Lubricated Cryogenic Turbopumps (Preprint)", AIAA/ASME/SAE/ASEE Joint Propulsion Conference, Cincinnati, OH, Jul. 8-11, 2007, 38 pages.
Sarkar, J., and Bhattacharyya, Souvik, "Optimization of Recompression S-CO2 Power Cycle with Reheating" Energy Conversion and Management 50 (May 17, 2009), pp. 1939-1945.
Thorin, Eva, "Power Cycles with Ammonia-Water Mixtures as Working Fluid", Doctoral Thesis, Department of Chemical Engineering and Technology Energy Processes, Royal Institute of Technology, Stockholm, Sweden, 2000, 66 pages.
Tom, Samsun Kwok Sun, "The Feasibility of Using Supercritical Carbon Dioxide as a Coolant for the Candu Reactor", The University of British Columbia, Jan. 1978, 156 pages.
"Two-flow rotors"; http://www.answers.com/topic/steam-turbine#ixzz2AJsKAwHX.
VGB PowerTech Service GmbH, "CO2 Capture and Storage", A VGB Report on the State of the Art, Aug. 25, 2004, 112 pages.
Vidhi, Rachana, et al., "Study of Supercritical Carbon Dioxide Power Cycle for Power Conversion from Low Grade Heat Sources", Presentation, University of South Florida and Oak Ridge National Laboratory, Supercritical CO2 Power Cycle Symposium, May 24-25, 2011, Boulder, CO, 17 pages.
Vidhi, Rachana, et al., "Study of Supercritical Carbon Dioxide Power Cycle for Power Conversion from Low Grade Heat Sources", Paper, University of South Florida and Oak Ridge National Laboratory, Supercritical CO2 Power Cycle Symposium, May 24-25, 2011, Boulder, CO, 8 pages.
Wright, Steven A., et al., "Modeling and Experimental Results for Condensing Supercritical CO2 Power Cycles", Sandia Report, Jan. 2011, 47 pages.
Wright, Steven A., et al., "Supercritical CO2 Power Cycle Development Summary at Sandia National Laboratories", May 24-25, 2011, (1 page, Abstract only).
Wright, Steven, "Mighty Mite", Mechanical Engineering, Jan. 2012, pp. 41-43.
Yoon, Ho Joon, et al., "Preliminary Results of Optimal Pressure Ratio for Supercritical CO2 Brayton Cycle coupled with Small Modular Water Cooled Reactor", Presentation, Korea Advanced

(56) References Cited

OTHER PUBLICATIONS

Institute of Science and Technology and Khalifa University of Science, Technology and Research, Boulder, CO, May 25, 2011, 18 pages.

Yoon, Ho Joon, et al., "Preliminary Results of Optimal Pressure Ratio for Supercritical CO2 Brayton Cycle coupled with Small Modular Water Cooled Reactor", Paper, Korea Advanced Institute of Science and Technology and Khalifa University of Science, Technology and Research, May 24-25, 2011, Boulder, CO, 7 pages.

* cited by examiner

HEAT ENGINE SYSTEMS WITH HIGH NET POWER SUPERCRITICAL CARBON DIOXIDE CIRCUITS

CROSS-REFERENCE TO RELATED APPLICATIONS

This application is a national stage application of PCT/US2014/020242, which was filed on Mar. 4, 2014, which claims priority to U.S. Prov. Appl. No. 61/782,400, which was filed on Mar. 14, 2013, U.S. Prov. Appl. No. 61/772,204, which was filed on Mar. 4, 2013, and U.S. Prov. Appl. No. 61/818,355, which was filed on May 1, 2013, the disclosures of which are incorporated herein by reference to the extent consistent with the present disclosure.

BACKGROUND

Waste heat is often created as a byproduct of industrial processes where flowing streams of high-temperature liquids, gases, or fluids must be exhausted into the environment or removed in some way in an effort to maintain the operating temperatures of the industrial process equipment. Some industrial processes utilize heat exchanger devices to capture and recycle waste heat back into the process via other process streams. However, the capturing and recycling of waste heat is generally infeasible by industrial processes that utilize high temperatures or have insufficient mass flow or other unfavorable conditions.

Waste heat can be converted into useful energy by a variety of turbine generator or heat engine systems that employ thermodynamic methods, such as Rankine cycles or other power cycles. Rankine and similar thermodynamic cycles are typically steam-based processes that recover and utilize waste heat to generate steam for driving a turbine, turbo, or other expander connected to an electric generator, a pump, or other device.

An organic Rankine cycle utilizes a lower boiling-point working fluid, instead of water, during a traditional Rankine cycle. Exemplary lower boiling-point working fluids include hydrocarbons, such as light hydrocarbons (e.g., propane or butane) and halogenated hydrocarbon, such as hydrochlorofluorocarbons (HCFCs) or hydrofluorocarbons (HFCs) (e.g., R245fa). More recently, in view of issues such as thermal instability, toxicity, flammability, and production cost of the lower boiling-point working fluids, some thermodynamic cycles have been modified to circulate non-hydrocarbon working fluids, such as ammonia.

One of the dominant forces in the operation of a power cycle or another thermodynamic cycle is being efficient at the heat addition step. Poorly designed heat engine systems and cycles can be inefficient at heat to electrical power conversion in addition to requiring large heat exchangers to perform the task. Such systems deliver power at a much higher cost per kilowatt than highly optimized systems. Heat exchangers that are capable of handling such high pressures and temperatures generally account for a large portion of the total cost of the heat engine system.

Therefore, there is a need for heat engine systems and methods for transforming energy, whereby the systems and methods provide maximum efficiency while generating work or electricity from thermal energy.

SUMMARY

Embodiments of the disclosure generally provide heat engine systems and methods for transforming energy, such as generating mechanical energy and/or electrical energy from thermal energy. Embodiments provide that the heat engine systems may have one of several different configurations of a working fluid circuit. In one embodiment, the heat engine system contains at least four heat exchangers and at least three recuperators sequentially disposed on a high pressure side of the working fluid circuit between a system pump and an expander. In another embodiment, a heat engine system contains a low-temperature heat exchanger and a recuperator disposed upstream of a split flowpath and downstream of a recombined flowpath in the high pressure side of the working fluid circuit.

In one or more embodiments described herein, a heat engine system contains a working fluid circuit, a plurality of heat exchangers, and a plurality of recuperators such that the heat exchangers and the recuperators are sequentially and alternatingly disposed in the working fluid circuit. The working fluid circuit generally has a high pressure side and a low pressure side and further contains a working fluid. In many examples, at least a portion of the working fluid circuit contains the working fluid in a supercritical state and the working fluid contains carbon dioxide. Each of the heat exchangers may be fluidly coupled to and in thermal communication with the high pressure side of the working fluid circuit. The heat exchangers may be configured to be fluidly coupled to and in thermal communication with a heat source, and configured to transfer thermal energy from the heat source to the working fluid within the high pressure side. Each of the recuperators may be fluidly coupled to the working fluid circuit and configured to transfer thermal energy between the high pressure side and the low pressure side of the working fluid circuit. The heat engine system may further contain an expander and a driveshaft. The expander may be fluidly coupled to the working fluid circuit and disposed between the high pressure side and the low pressure side and configured to convert a pressure drop in the working fluid to mechanical energy. The driveshaft may be coupled to the expander and configured to drive a device with the mechanical energy. The heat engine system may further contain a system pump and a cooler (e.g., condenser). The system pump may be fluidly coupled to the working fluid circuit between the low pressure side and the high pressure side of the working fluid circuit and configured to circulate or pressurize the working fluid within the working fluid circuit. The cooler may be in thermal communication with the working fluid in the low pressure side of the working fluid circuit and configured to remove thermal energy from the working fluid in the low pressure side of the working fluid circuit.

In some examples, the plurality of heat exchangers contains four or more heat exchangers and the plurality of recuperators contains three or more recuperators. In one exemplary configuration, a first recuperator may be disposed between a first heat exchanger and a second heat exchanger, a second recuperator may be disposed between the second heat exchanger and a third heat exchanger, and a third recuperator may be disposed between the third heat exchanger and a fourth heat exchanger. The first heat exchanger may be disposed downstream of the first recuperator and upstream of the expander on the high pressure side. The fourth heat exchanger may be disposed downstream of the system pump and upstream of the third recuperator on the high pressure side. The cooler may be disposed downstream of the third recuperator and upstream of the system pump on the low pressure side.

In one or more embodiments described herein, a heat engine system is provided and contains a working fluid circuit having a high pressure side and a low pressure side and containing a working fluid, wherein at least a portion of the working fluid circuit contains the working fluid in a supercritical state and the working fluid contains carbon dioxide. The heat engine system may further contain a high-temperature heat exchanger and a low-temperature heat exchanger. Each of the high-temperature and low-temperature heat exchangers may be fluidly coupled to and in thermal communication with the high pressure side of the working fluid circuit. Also, the high-temperature and low-temperature heat exchangers may be configured to be fluidly coupled to and in thermal communication with a heat source, and configured to transfer thermal energy from the heat source to the working fluid within the high pressure side.

The heat engine system also contains a recuperator fluidly coupled to the working fluid circuit and configured to transfer thermal energy between the high pressure side and the low pressure side of the working fluid circuit. The recuperator may be disposed downstream of the expander and upstream of the cooler on the low pressure side of the working fluid circuit. The cooler may be disposed downstream of the recuperator and upstream of the system pump on the low pressure side of the working fluid circuit.

The heat engine system may further contain an expander and a driveshaft. The expander may be fluidly coupled to the working fluid circuit and disposed between the high pressure side and the low pressure side and configured to convert a pressure drop in the working fluid to mechanical energy. The driveshaft may be coupled to the expander and configured to drive a device with the mechanical energy. The heat engine system may further contain a system pump fluidly coupled to the working fluid circuit between the low pressure side and the high pressure side of the working fluid circuit and configured to circulate or pressurize the working fluid within the working fluid circuit. The heat engine system also contains a cooler (e.g., condenser) in thermal communication with the working fluid in the low pressure side of the working fluid circuit and configured to remove thermal energy from the working fluid in the low pressure side of the working fluid circuit.

In one exemplary embodiment, the heat engine system may further contain a split flowpath and a recombined flowpath within the high pressure side of the working fluid circuit. The split flowpath may contain a split junction disposed downstream of the system pump and upstream of the low-temperature heat exchanger and the recuperator. The split flowpath may extend from the split junction to the low-temperature heat exchanger and the recuperator. The recombined flowpath may contain a recombined junction disposed downstream of the low-temperature heat exchanger and the recuperator and upstream of the high-temperature heat exchanger. The recombined flowpath may extend from the low-temperature heat exchanger and the recuperator to the recombined junction.

The heat engine system may contain at least one valve at or near (e.g., upstream of) the split junction, the recombined junction, or both the split and recombined junctions. In some exemplary configurations, the valve may be an isolation shut-off valve or a modulating valve disposed upstream of the split junction. In other exemplary configurations, the valve may be a three-way valve disposed at the split or recombined junction. The valve may be configured to control the relative or proportional flowrate of the working fluid passing through the low-temperature heat exchanger and the recuperator.

In another exemplary embodiment, the heat engine system may further contain a bypass line having an inlet end and an outlet end and configured to flow the working fluid around the low-temperature heat exchanger and to the recuperator, wherein the inlet end of the bypass line is fluidly coupled to the high pressure side at a split junction disposed downstream of the system pump and upstream of the low-temperature heat exchanger and the outlet end of the bypass line is fluidly coupled to an inlet of the recuperator on the high pressure side. Also, the heat engine system contains a recuperator fluid line having an inlet end and an outlet end. In one configuration, the inlet end of the recuperator fluid line is fluidly coupled to an outlet of the recuperator on the high pressure side and the outlet end of the recuperator fluid line is fluidly coupled to the high pressure side at a recombined junction disposed downstream of the low-temperature heat exchanger and upstream of the high-temperature heat exchanger.

In another exemplary configuration, the heat engine system may further contain a segment of the high pressure side configured to flow the working fluid from the system pump, through the bypass line, through the recuperator, through the fluid line, through the high-temperature heat exchanger, and to the expander. Also, another segment of the high pressure side may be configured to flow the working fluid from the system pump, through the low-temperature heat exchanger and the high-temperature heat exchanger while bypassing the recuperator, and to the expander.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Embodiments of the disclosure generally provide heat engine systems and methods for transforming energy, such as generating mechanical energy and/or electrical energy from thermal energy. Embodiments provide that the heat engine systems may have one of several different configurations of a working fluid circuit. In one embodiment, the heat engine system contains at least four heat exchangers and at least three recuperators sequentially and alternatingly disposed on a high pressure side of the working fluid circuit between a system pump and an expander. In another embodiment, a heat engine system contains a low-temperature heat exchanger and a recuperator disposed upstream of a split flowpath and downstream of a recombined flowpath in the high pressure side of the working fluid circuit.

The heat engine system, as described herein, is configured to efficiently convert thermal energy of a heated stream (e.g., a waste heat stream) into valuable mechanical energy and/or electrical energy. The heat engine system may utilize the working fluid in a supercritical state (e.g., sc-$CO_2$) and/or a subcritical state (e.g., sub-$CO_2$) contained within the working fluid circuit for capturing or otherwise absorbing thermal energy of the waste heat stream with one or more heat exchangers. The thermal energy may be transformed to mechanical energy by a power turbine and subsequently transformed to electrical energy by a power generator coupled to the power turbine. The heat engine system contains several integrated sub-systems managed by a process control system for maximizing the efficiency of the heat engine system while generating mechanical energy and/or electrical energy.

Figure 1:
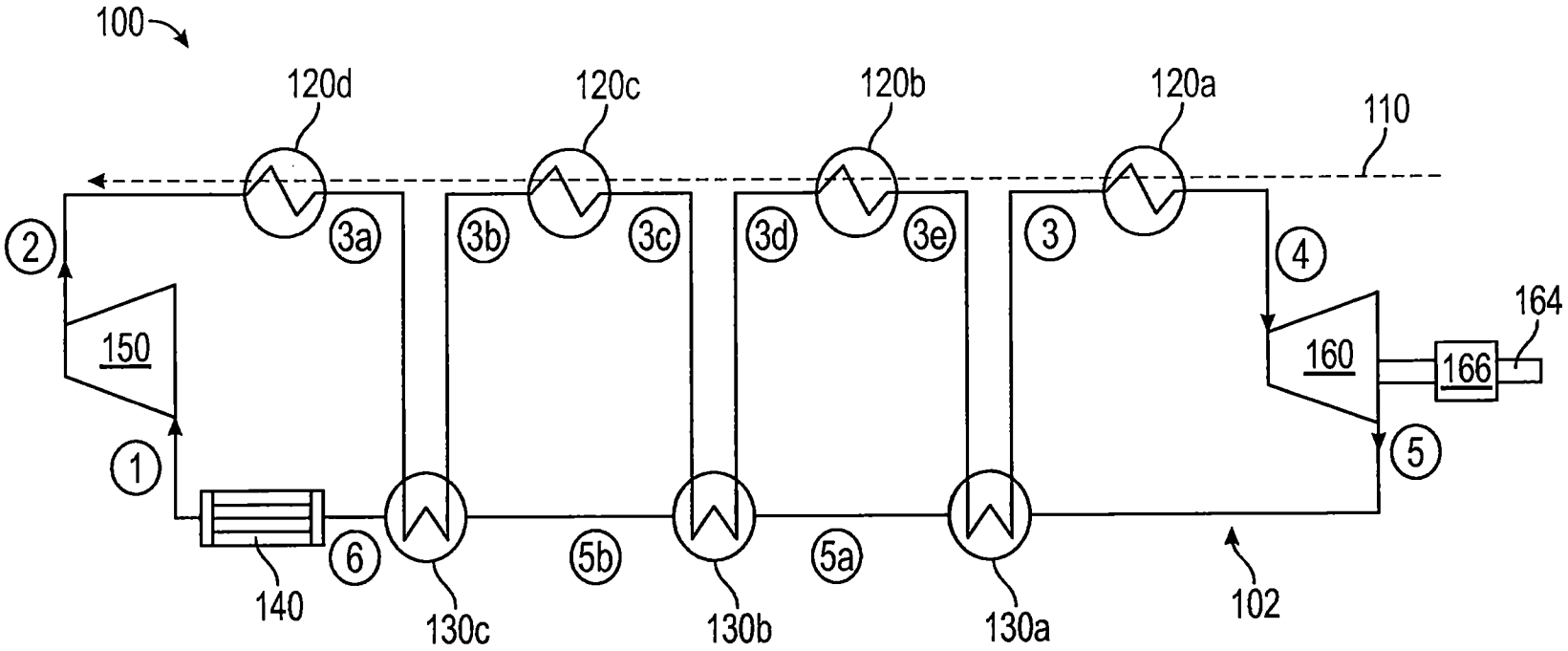
FIG. 1 depicts an exemplary heat engine system containing four heat exchangers and three recuperators sequentially and alternatingly disposed on the high pressure side of the working fluid, according to one or more embodiments disclosed herein.

In one or more embodiments described herein, as depicted in FIG. 1, a heat engine system 100 is provided and contains a working fluid circuit 102, a plurality of heat exchangers 120*a*-120*d*, and a plurality of recuperators 130*a*-130*c*. The working fluid circuit 102 generally has a high pressure side and a low pressure side and further contains a working fluid. In many examples, at least a portion of the working fluid circuit 102 contains the working fluid in a supercritical state and the working fluid contains carbon dioxide. The heat exchangers 120*a*-120*d* and the recuperators 130*a*-130*c* are sequentially and alternatingly disposed in the high pressure side of the working fluid circuit 102.

Each of the heat exchangers 120*a*-120*d* may be fluidly coupled to and in thermal communication with the high pressure side of the working fluid circuit 102. Also, each of the heat exchangers 120*a*-120*d* is configured to be fluidly coupled to and in thermal communication with a heat source 110 and configured to transfer thermal energy from the heat source 110 to the working fluid within the high pressure side. Each of the recuperators 130*a*-130*c* is independently in fluid and thermal communication with the high and low pressure sides of the working fluid circuit 102. The recuperators 130*a*-130*c* are configured to transfer thermal energy between the high pressure side and the low pressure side of the working fluid circuit 102.

The heat engine system 100 further contains an expander 160 and a driveshaft 164. The expander 160 may be fluidly coupled to the working fluid circuit 102 and disposed between the high and low pressure sides and configured to convert a pressure drop in the working fluid to mechanical energy. The driveshaft 164 may be coupled to the expander 160 and configured to drive one or more devices, such as a generator or alternator (e.g., a power generator 166), a motor, a pump or compressor (e.g., the system pump 150), and/or other device, with the generated mechanical energy.

The heat engine system 100 further contains a system pump 150 and a cooler 140 (e.g., condenser). The system pump 150 may be fluidly coupled to the working fluid circuit 102 between the low pressure side and the high pressure side of the working fluid circuit 102. Also, the system pump 150 may be configured to circulate and/or pressurize the working fluid within the working fluid circuit 102. The cooler 140 may be in thermal communication with the working fluid in the low pressure side of the working fluid circuit 102 and configured to remove thermal energy from the working fluid in the low pressure side of the working fluid circuit 102.

After exiting the system pump 150, the working fluid sequentially and alternately flows through the heat exchangers 120*a*-120*d* and the recuperators 130*a*-130*c* before entering the expander 160. The sequentially alternating nature of positioned heat exchangers 120*a*-120*d* and recuperators 130*a*-130*c* within the working fluid circuit 102 provides large temperature differentials to be maintained across the heat exchangers 120*a*-120*d*, thereby reducing the required heat transfer area for a given power output, or conversely increasing the power output for a given amount of heat transfer area. The alternating pattern may be applied at infinitum for any given configuration of the heat engine system 100 subject only to the practical handling of large numbers of components and pipe segments.

Generally, the heat engine system 100 contains at least four heat exchangers and at least three recuperators, as depicted by the heat exchangers 120*a*-120*d* and the recuperators 130*a*-130*c*, but the heat engine system 100 may contain more or less of heat exchangers and/or recuperators depending on the specific use of the heat engine system 100. In one exemplary configuration, a (first) recuperator 130*a* may be disposed between a (first) heat exchanger 120*a* and a (second) heat exchanger 120*b*, a (second) recuperator 130*b* may be disposed between the heat exchanger 120*b* and a (third) heat exchanger 120*c*, and a (third) recuperator 130*c* may be disposed between the heat exchanger 120*c* and a (fourth) heat exchanger 120*d*. The heat exchanger 120*a* may be disposed downstream of the recuperator 130*a* and upstream of the expander 160 on the high pressure side. The heat exchanger 120*d* may be disposed downstream of the system pump 150 and upstream of the recuperator 130*c* on the high pressure side. The cooler 140 may be disposed downstream of the recuperator 130*c* and upstream of the system pump 150 on the low pressure side.

Figure 2:
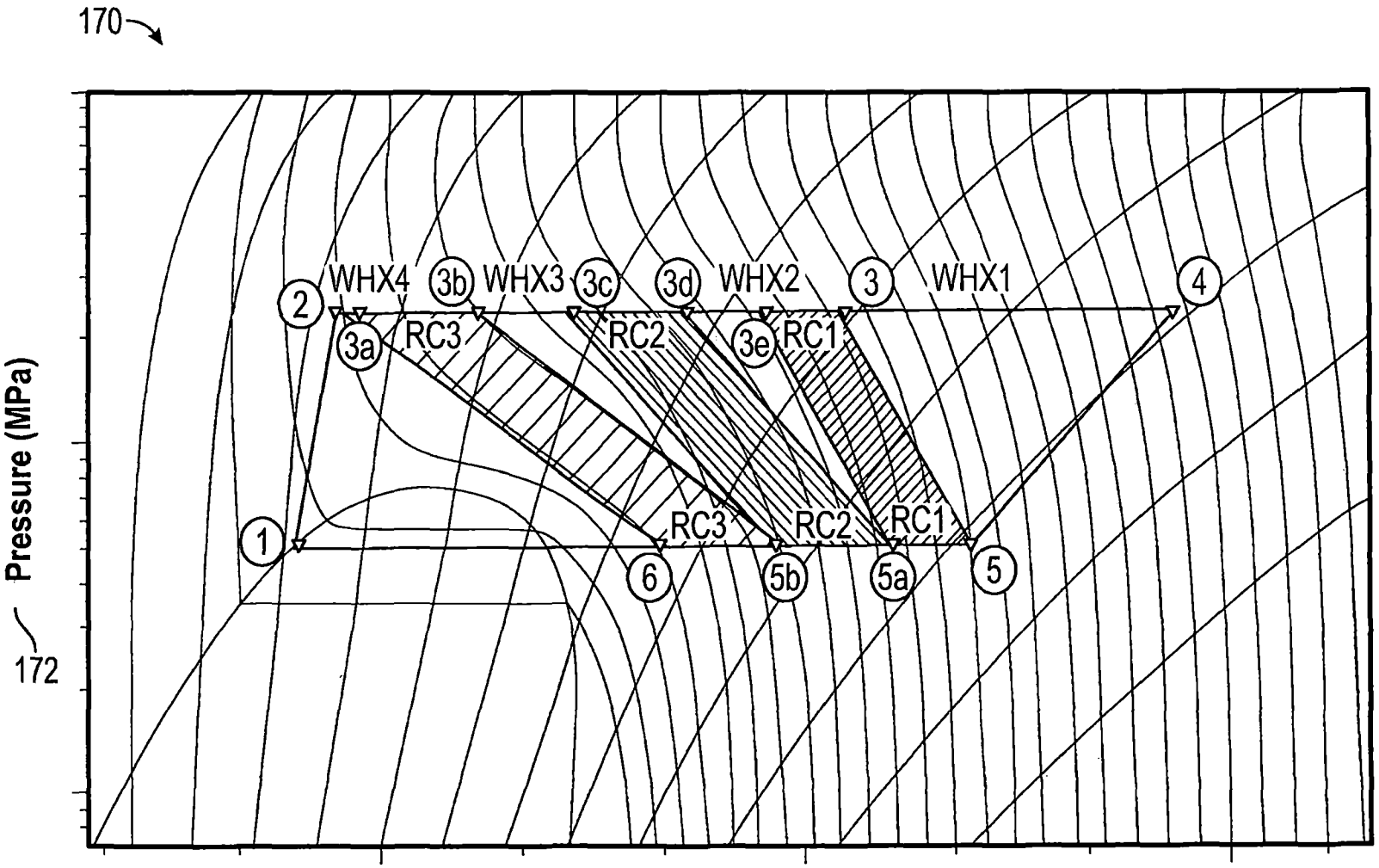
FIG. 2 illustrates a pressure versus enthalpy chart for a thermodynamic cycle produced by the heat engine system depicted in FIG. 1, according to one or more embodiments disclosed herein.

FIG. 2 is a chart 170 that graphically illustrates the pressure 172 versus the enthalpy 174 for a thermodynamic cycle produced by the heat engine system 100, according to one or more embodiments disclosed herein. The pressure versus enthalpy chart illustrates labeled state points 1, 2, 3*a*, 3*b*, 3*c*, 3*d*, 3*e*, 3, 4, 5, 5*a*, 5*b*, and 6 for the thermodynamic cycle of the heat engine system 100. In FIG. 2, the heat exchangers 120*a*, 120*b*, 120*c*, and 120*d* are respectively labeled as WHX1, WHX2, WHX3, and WHX4, and the recuperators 130*a*, 130*b*, and 130*c* are respectively labeled as RC1, RC2, and RC3. The "wedge-like" nature of each heat exchanger and recuperator combination, for the heat exchangers 120*a*-120*d* and the recuperators 130*a*-130*c*, outlines the sequentially alternating heat exchanger pattern.

Figure 3:
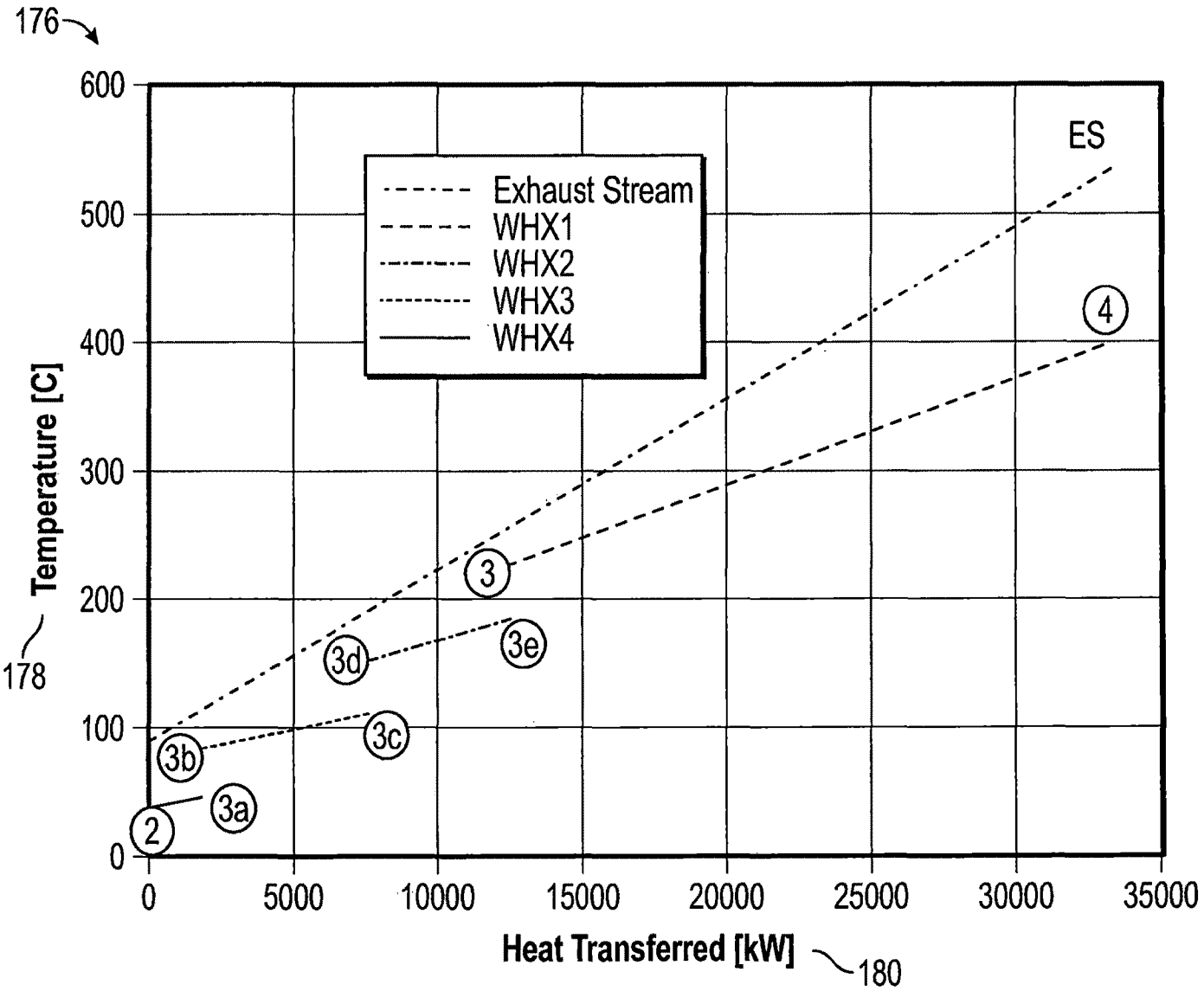
FIG. 3 illustrates a temperature trace chart for a thermodynamic cycle produced by the heat engine system depicted in FIG. 1, according to one or more embodiments disclosed herein.

FIG. 3 illustrates a temperature trace chart 176 for a thermodynamic cycle produced by the heat engine system 100, according to one or more embodiments disclosed herein. The labeled points 2, 3*a*, 3*b*, 3*c*, 3*d*, 3*e*, 3, and 4 in the pressure versus enthalpy chart 170 of FIG. 2 are applied in the temperature trace chart 176 of FIG. 3 having a temperature axis 178 and a heat transferred axis 180. The chart 176 in FIG. 3 illustrates the temperature trace through the heat source 110 (e.g., a waste heat stream or other thermal stream) and each of the recuperators 130*a*-130*c*, which shows that the high temperature difference is maintained throughout the heat exchangers 120*a*-120*d*. The heat source 110 is an exhaust stream and the temperature trace of the heat source 110 is depicted by the line labeled ES. The temperature trace of the heat exchanger 120*a* is depicted by the line extending between points 3 and 4. The temperature trace of the heat exchanger 120*b* is depicted by the line extending between points 3*d* and 3*e*. The temperature trace of the heat exchanger 120*c* is depicted by the line extending between points 3*b* and 3*c*. The temperature trace of the heat exchanger 120*d* is depicted by the line extending between points 2 and 3*a*. The large temperature difference reduces the needed amount of heat transfer area. Additionally, the heat engine system 100 and methods described herein effectively mitigate the changing specific heat at low temperatures and high pressures, as seen by the changing slope of each waste heat exchanger temperature trace in FIG. 3.

Figure 4A:
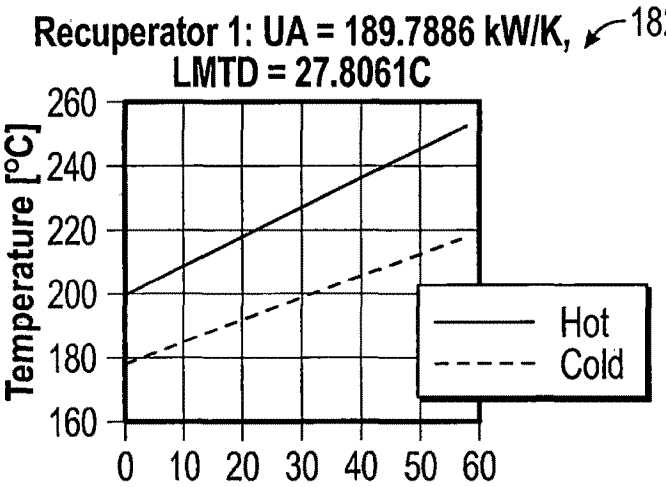
FIGS. 4A-4C illustrate recuperator temperature trace charts for a thermodynamic cycle produced by the heat engine system depicted in FIG. 1, according to one or more embodiments disclosed herein.
Figure 4B:
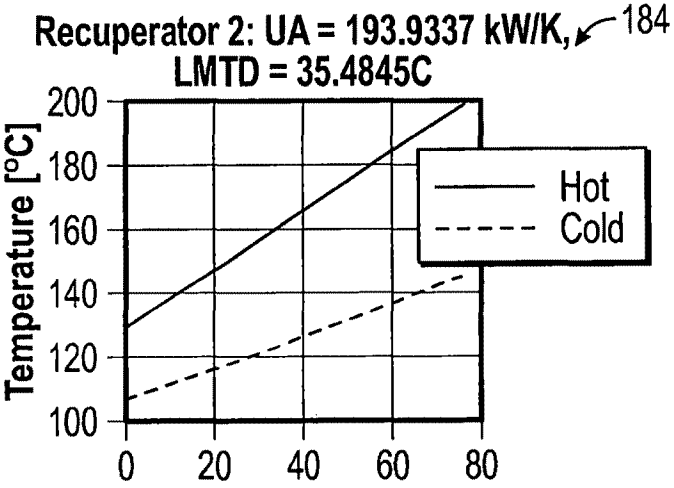
Figure 4C:
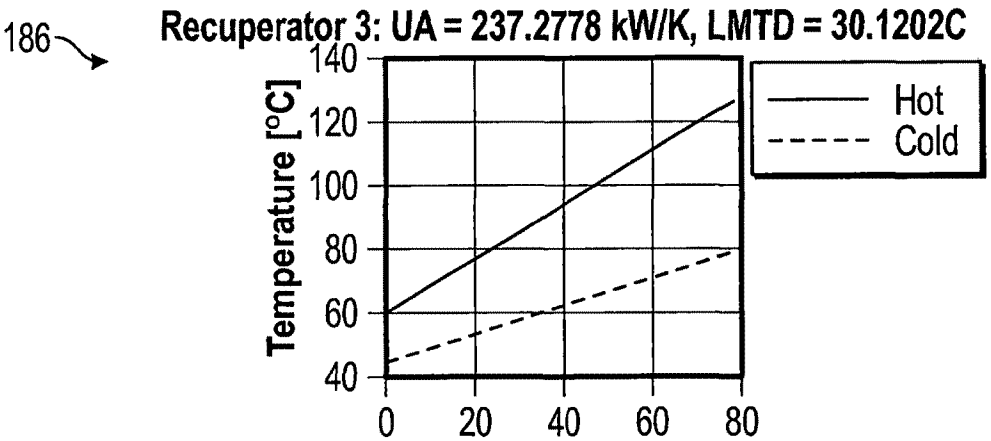

FIGS. 4A-4C illustrate recuperator temperature trace charts for a thermodynamic cycle produced by the heat engine system 100, according to one or more embodiments disclosed herein. FIG. 4A illustrates a recuperator temperature trace chart 182 for the recuperator 130*a*, FIG. 4B illustrates a recuperator temperature trace chart 184 for the recuperator 130*b*, and FIG. 4C illustrates a recuperator temperature trace chart 186 for the recuperator 130*c*. In one embodiment, one of the benefits to the described power cycle includes greater use of recuperation as ambient temperature increases, minimizing the costly waste heat exchanger, and increasing the net system output power, for example, such as greater than 15% for some ambient conditions with the heat engine system 100.

Figure 5:
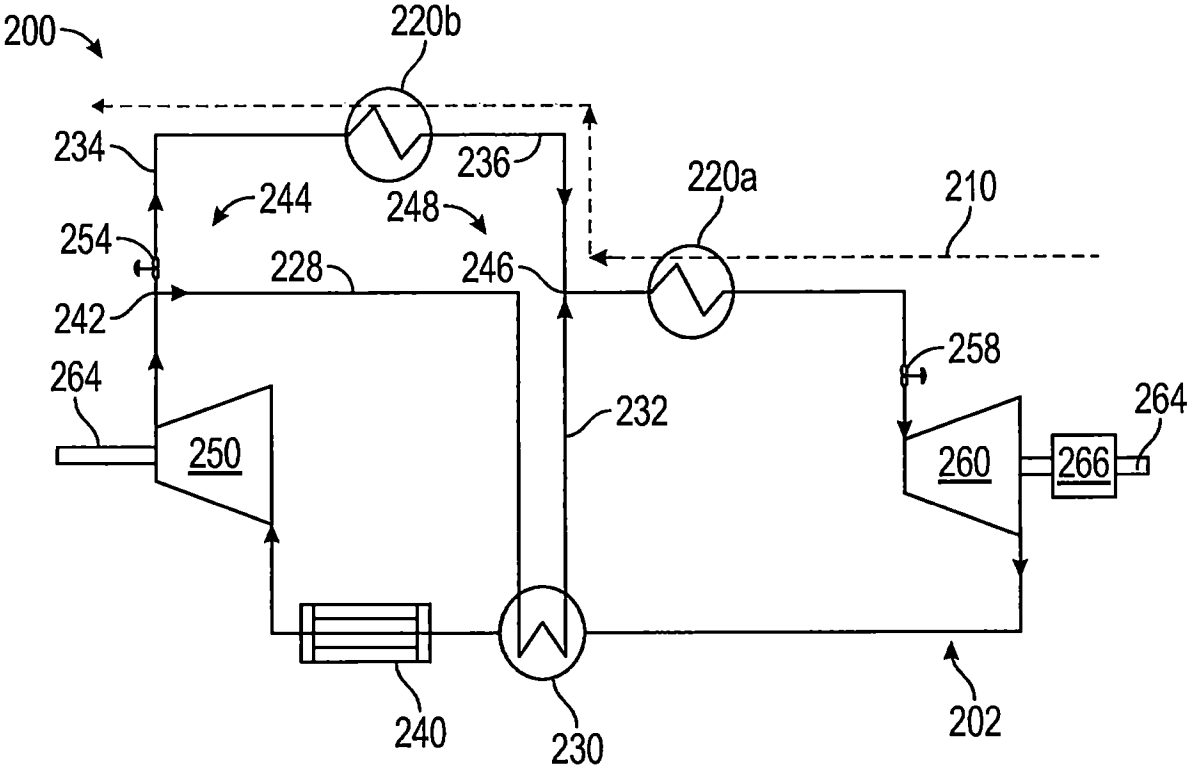
FIG. 5 depicts an exemplary heat engine system containing a working fluid circuit with a split flowpath upstream of a low-temperature heat exchanger and a recuperator and a recombined flowpath upstream of a high-temperature heat exchanger and an expander, according to one or more embodiments disclosed herein.
Figure 6:
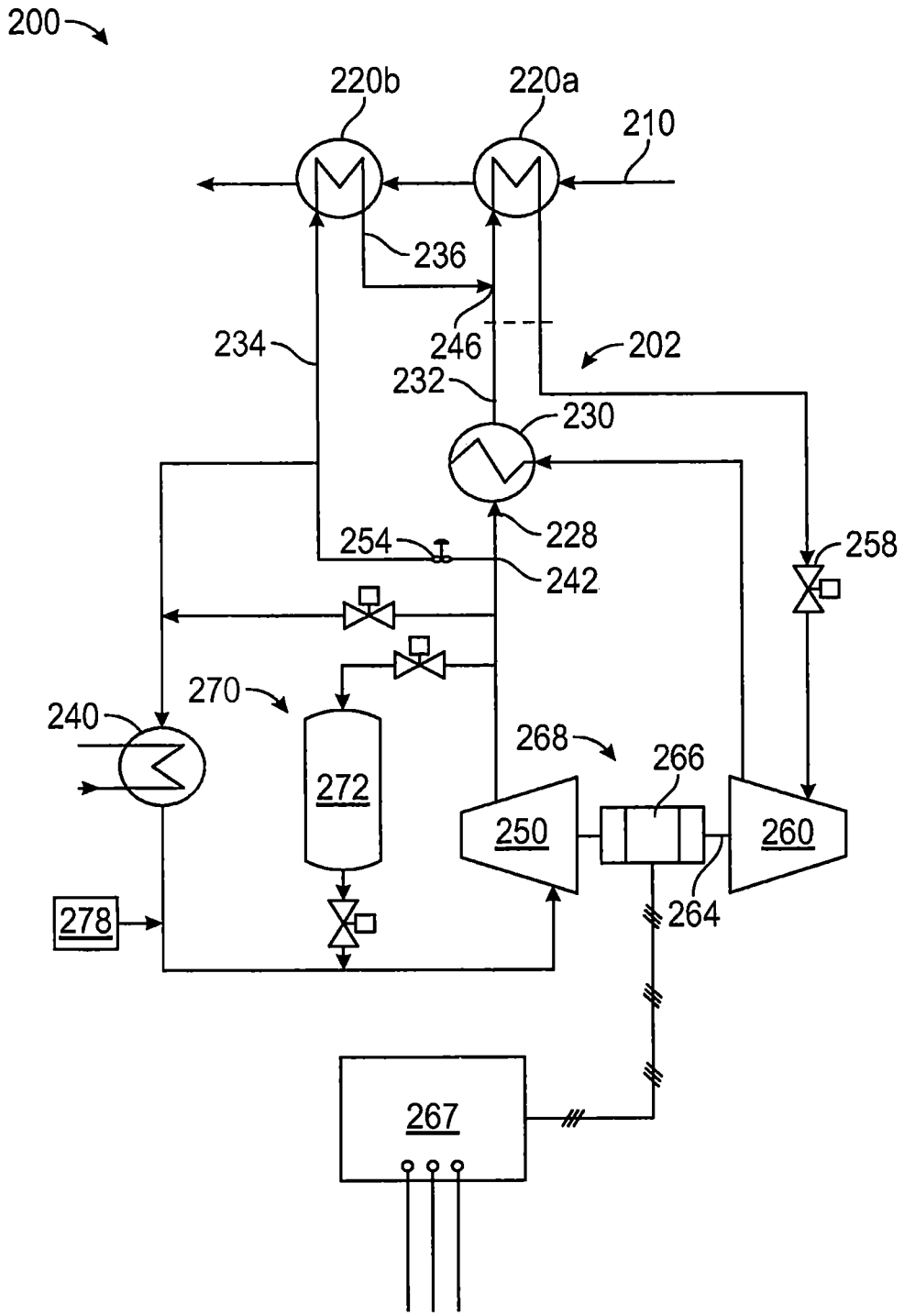
FIG. 6 depicts another exemplary heat engine system containing a working fluid circuit with a split flowpath upstream of a low-temperature heat exchanger and a recuperator and a recombined flowpath upstream of a high-temperature heat exchanger and an expander, according to one or more embodiments disclosed herein.

In one or more embodiments described herein, as depicted in FIGS. 5 and 6, a heat engine system 200 is provided and contains a working fluid circuit 202 with a split flowpath 244 upstream of a low-temperature heat exchanger 220*b* and a recuperator 230 and a recombined flowpath 248 upstream of a high-temperature heat exchanger 220*a* and an expander 260, according to one or more embodiments disclosed herein. The working fluid circuit 202 has a high pressure side and a low pressure side and contains a working fluid that is circulated and pressurized within the high and low pressure sides. The split flowpath 244 and the recombined flowpath 248 are disposed within the high pressure side of the working fluid circuit 202. The low-temperature heat exchanger 220*b* and the recuperator 230 are both disposed upstream of a split flow junction 242 and the split flowpath 244. The recombined flowpath 248 extends from the outlets of the low-temperature heat exchanger 220*b* and the recuperator 230 and to a recombined junction 246. The high-temperature heat exchanger 220*a* may be disposed downstream of the recombined flowpath 248 and the recombined junction 246.

Generally, at least a portion of the working fluid circuit 202 contains the working fluid in a supercritical state and the working fluid contains carbon dioxide. The high-temperature heat exchanger 220*a* and the low-temperature heat exchanger 220*b* may each be fluidly coupled to and in thermal communication with the high pressure side of the working fluid circuit 202. The high-temperature heat exchanger 220*a* and the low-temperature heat exchanger 220*b* are configured to be fluidly coupled to and in thermal communication with a heat source 210, and configured to transfer thermal energy from the heat source 210 to the working fluid within the high pressure side of the working fluid circuit 202.

The recuperator 230 may be fluidly coupled to the working fluid circuit 202 and configured to transfer thermal energy between the high pressure side and the low pressure side of the working fluid circuit 202. The recuperator 230 may be disposed downstream of the expander 260 (e.g., a turbine) and upstream of a cooler 240 (e.g., a condenser) on the low pressure side of the working fluid circuit 202. The cooler 240 may be in thermal communication with the working fluid in the low pressure side of the working fluid circuit 202. The cooler 240 may be disposed downstream of the recuperator 230 and upstream of the system pump 250 on the low pressure side of the working fluid circuit 202. The cooler 240 may be configured to remove thermal energy from the working fluid in the low pressure side of the working fluid circuit 202. The system pump 250 may be fluidly coupled to the working fluid circuit 202 between the high and low pressure sides of the working fluid circuit 202. The system pump 250 may be configured to circulate and/or pressurize the working fluid within the working fluid circuit 202.

The expander 260 may be fluidly coupled to the working fluid circuit 202 and disposed between the high pressure side and the low pressure side. The expander 260 may be configured to convert a pressure drop in the working fluid to mechanical energy. A driveshaft 264 may be coupled to the expander 260 and configured to drive one or more devices, such as a generator or alternator (e.g., a power generator 266), a motor, a pump or compressor (e.g., the system pump 250), and/or other device, with the generated mechanical energy.

In one exemplary embodiment, the heat engine system 200 may further contain a split flowpath 244 and a recombined flowpath 248 within the high pressure side of the working fluid circuit 202. The split flowpath 244 may contain a split junction 242 disposed downstream of the system pump 250 and upstream of the low-temperature heat exchanger 220*b* and the recuperator 230. The split flowpath 244 may extend from the split junction 242 to the low-temperature heat exchanger 220*b* and the recuperator 230. The recombined flowpath 248 may contain a recombined junction 246 disposed downstream of the low-temperature heat exchanger 220*b* and the recuperator 230 and upstream of the high-temperature heat exchanger 220*a*. The recombined flowpath 248 may extend from the low-temperature heat exchanger 220*b* and the recuperator 230 to the recombined junction 246.

The heat engine system 200 may contain at least one valve at or near (e.g., upstream of) the split junction 242, the recombined junction 246, or both the split and recombined junction 246*s*. In some exemplary configurations, the valve 254 may be an isolation shut-off valve or a modulating valve disposed upstream of the split junction 242. In other exemplary configurations, the valve 254 may be a three-way valve disposed at the split or recombined junction 246. The valve 254 may be configured to control the relative or proportional flowrate of the working fluid passing through the low-temperature heat exchanger 220*b* and the recuperator 230.

In other embodiments, the heat engine system 200 may contain at least one throttle valve, such as a turbine throttle valve 258, which may be utilized to control the expander 260. The turbine throttle valve 258 may be coupled between and in fluid communication with a fluid line extending from the high-temperature heat exchanger 220*a* to the inlet on the expander 260. The turbine throttle valve 258 may be configured to modulate the flow of the heated working fluid into the expander 260, which in turn may be utilized to adjust the rotation rate of the expander 260. Hence, in one embodiment, the amount of electrical energy generated by the power generator 266 may be controlled, in part, by the turbine throttle valve 258. In another embodiment, if the driveshaft 264 is coupled to the system pump 250, the flow of the working fluid throughout the working fluid circuit 202 may be controlled, in part, by the turbine throttle valve 258.

FIGS. 5 and 6 depict the process/cycle diagram for the heat engine system 200. After exiting the system pump, the flow of the working fluid (e.g., carbon dioxide) may be split between the low-temperature heat exchanger 220*b* and the recuperator 230. Subsequently, the split flows of the working fluid may be mixed or otherwise combined prior to entering the high-temperature heat exchanger 220*a*. The heat engine system 200 provides for a compact design by minimizing components and lines required to connect the different components. In some configurations, control of the flow split, such as controlling the ratio of the working fluid dispersed between the recuperator 230 and the low-temperature heat exchanger 220*b*, may be utilized to regulate temperatures and balance the flow for different ambient conditions throughout the working fluid circuit 202.

Figure 7:
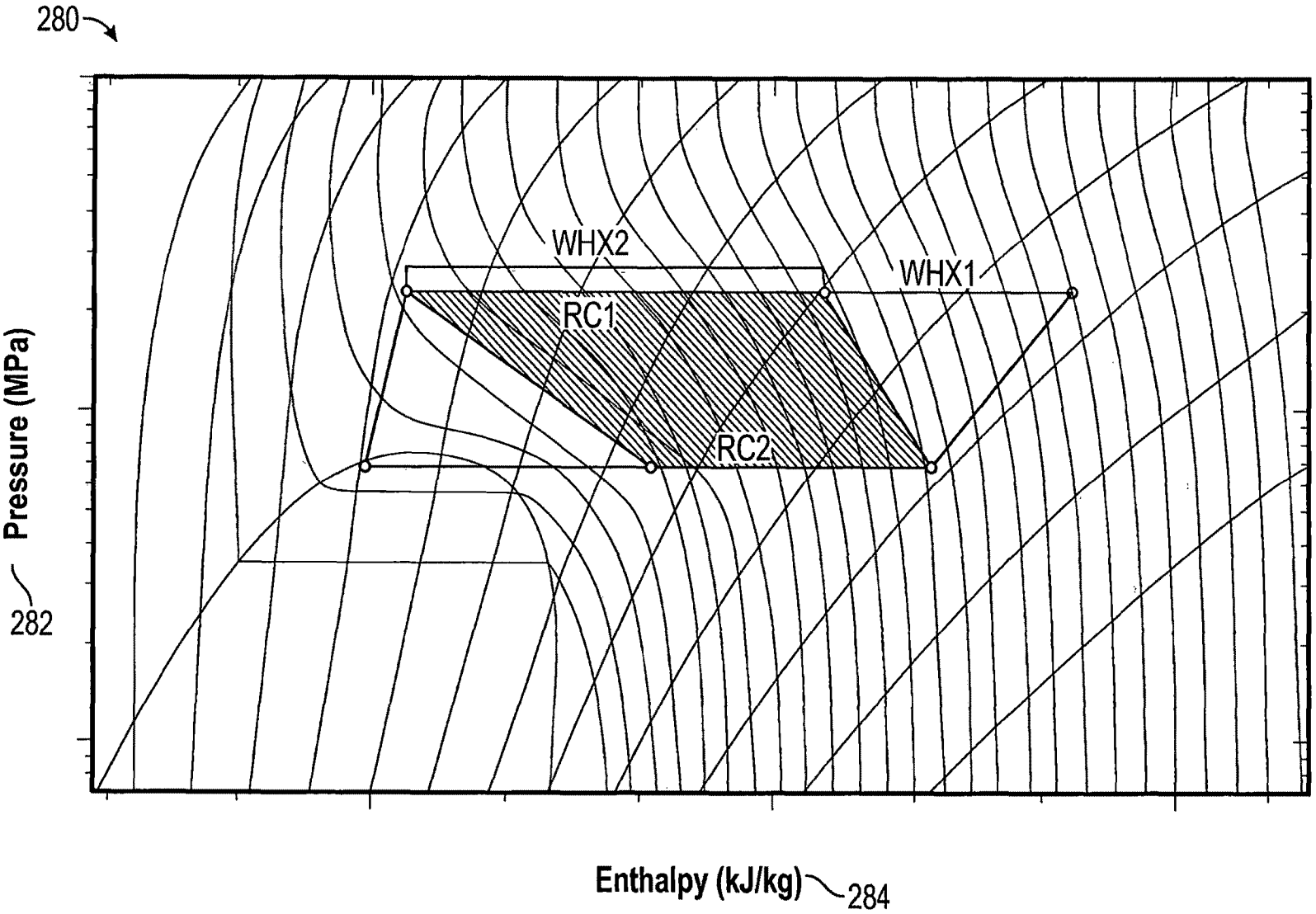
FIG. 7 illustrates a pressure versus enthalpy chart for a thermodynamic cycle produced by the heat engine system depicted in FIG. 5, according to one or more embodiments disclosed herein.

FIG. 7 is a chart 280 that graphically illustrates the pressure 282 versus the enthalpy 284 for a thermodynamic cycle produced by the heat engine system 200, according to one or more embodiments disclosed herein. The pressure versus enthalpy chart 280 illustrates labeled state points for the thermodynamic cycle of the heat engine system 200. In FIG. 7, the heat exchangers 220*a* and 220*b* and the recuperator 230 are respectively labeled as WHX1, WHX2, and RC1. The split junction 242 and the split flowpath 244 may be tailored to achieve a reduced or otherwise desirable temperature within the heat engine system 200, as well as to maximize the generated power (e.g., electricity or work power). In some examples, the flow path through the low-temperature heat exchanger 220*b* may be at the same pressure as the flow path through the recuperator 230. The plot 280, illustrated in FIG. 7, has been offset to clearly show the difference between recuperation and waste heat exchange.

Figure 8B:
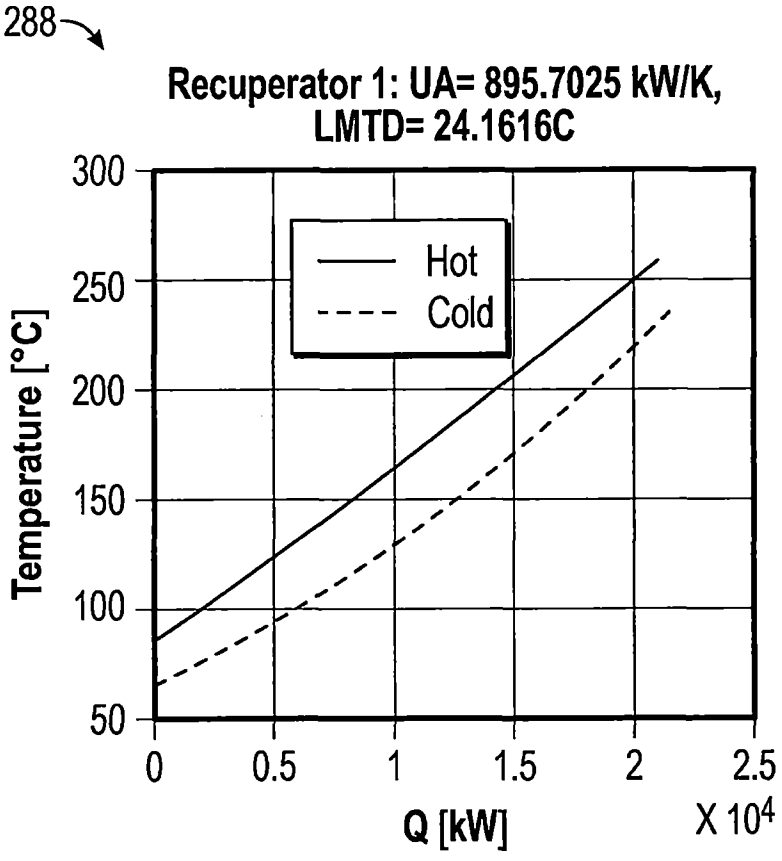
FIGS. 8A and 8B illustrate temperature trace charts for a thermodynamic cycle produced by the heat engine system depicted in FIG. 5, according to one or more embodiments disclosed herein.
Figure 8A:
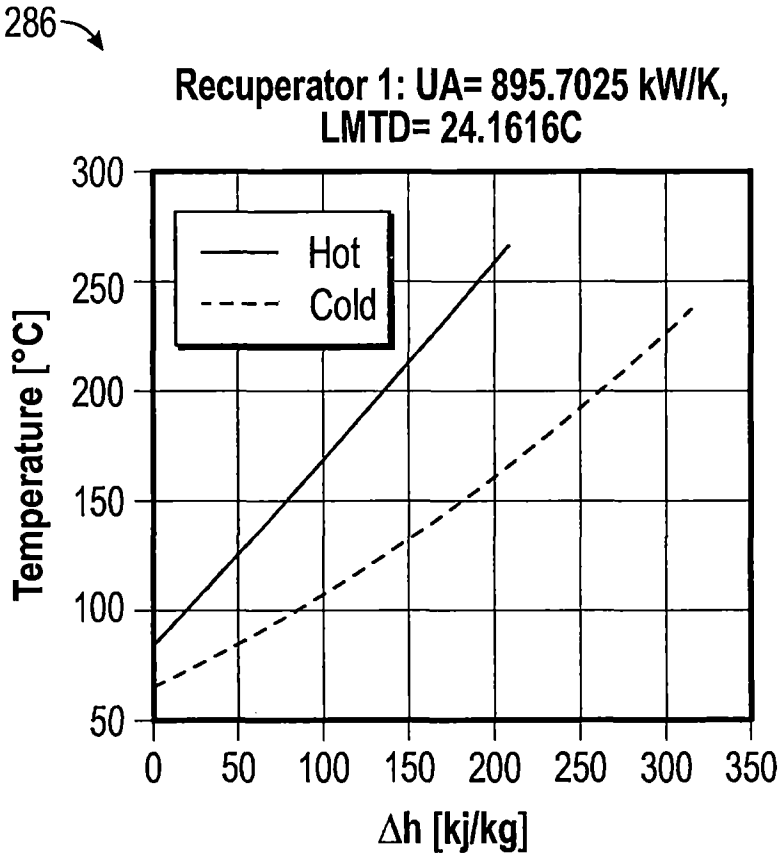

FIGS. 8A and 8B illustrate temperature trace charts 286 and 288, respectively, for a thermodynamic cycle produced by the heat engine system 200, according to one or more embodiments disclosed herein. Since the recuperator 230 will generally have different mass flow on each side, the enthalpy change of each fluid will be different while the heat transferred remains equal or substantially equal, as shown in FIGS. 8A and 8B. In some examples, adjusting the mass flow split at the split junction 242 will determine how the recuperator 230 performs at various conditions exposed to the heat engine system 200. Several of the benefits of the thermodynamic cycle produced by the heat engine system 200 include reducing the amount of system components, maximizing the power output, adjustability of the mass flow for different conditions, maximizing the waste heat input, and minimizing the amount of waste heat exchanger in the exhaust stream and piping runs.

In another exemplary embodiment, as shown in FIG. 6, the heat engine system 200 may further contain a bypass line 228 having an inlet end and an outlet end and configured to flow the working fluid around the low-temperature heat exchanger 220*b* and to the recuperator 230. The inlet end of the bypass line 228 may be fluidly coupled to the high pressure side at a split junction 242 disposed downstream of the system pump 250 and upstream of the low-temperature heat exchanger 220*b*. The outlet end of the bypass line 228 may be fluidly coupled to an inlet of the recuperator 230 on the high pressure side. Also, the heat engine system 200 contains a recuperator fluid line 232 having an inlet end and an outlet end. The inlet end of the recuperator fluid line 232 may be fluidly coupled to an outlet of the recuperator 230 on the high pressure side. The outlet end of the recuperator fluid line 232 may be fluidly coupled to the high pressure side at a recombined junction 246 disposed downstream of the low-temperature heat exchanger 220*b* and upstream of the high-temperature heat exchanger 220*a*.

The heat engine system 200 also contains a process line 234 having an inlet end and an outlet end and configured to flow the working fluid around the recuperator 230 to the low-temperature heat exchanger 220*b*. The inlet end of the process line 234 may be fluidly coupled to the high pressure side at the split junction 242 and the outlet end of the process line 234 may be fluidly coupled to an inlet of the low-temperature heat exchanger 220*b* on the high pressure side. Also, the heat engine system 200 contains a heat exchanger fluid line 236 having an inlet end and an outlet end. The inlet end of the heat exchanger fluid line 236 may be fluidly coupled to an outlet of the low-temperature heat exchanger 220*b* and the outlet end of the heat exchanger fluid line 236 may be fluidly coupled to the recombined junction 246.

In another exemplary configuration, the heat engine system 200 further contains a segment of the high pressure side configured to flow the working fluid from the system pump 250, through the bypass line 228, through the recuperator 230, through the recuperator fluid line 232, through the high-temperature heat exchanger 220*a*, and to the expander 260. Also, another segment of the high pressure side may be configured to flow the working fluid from the system pump 250, through the low-temperature heat exchanger 220*b* and the high-temperature heat exchanger 220*a* while bypassing the recuperator 230, and to the expander 260.

In some examples, a variable frequency drive may be coupled to the system pumps 150, 250 and may be configured to control the mass flow rate or temperature of the working fluid within the working fluid circuits 102, 202. In various examples, the expanders 160, 260 may be a turbine or turbo device and the system pumps 150, 250 may be a start pump, a turbopump, or a compressor. In other examples, the system pumps 150, 250 may be coupled to the expanders 160, 260 by the driveshafts 164, 264 and configured to control mass flow rate or temperature of the working fluid within the working fluid circuits 102, 202. In other examples, the system pumps 150, 250 may be coupled to a secondary expander (not shown) and configured to control the mass flow rate or temperature of the working fluid within the working fluid circuits 102, 202. The heat engine systems 100, 200 may further contain a generator or an alternator coupled to the expanders 160, 260 by the driveshafts 164, 264 and configured to convert the mechanical energy into electrical energy. In some examples, the heat engine systems 100, 200 may contain a turbopump in the working fluid circuits 102, 202, wherein the turbopump contains a pump portion coupled to the expanders 160, 260 by the driveshafts 164, 264 and the pump portion is configured to be driven by the mechanical energy.

FIGS. 1, 5, and 6 depict exemplary heat engine systems 100, 200, which may also be referred to as a thermal engine system, an electrical generation system, a waste heat or other heat recovery system, and/or a thermal to electrical energy system, as described in one of more embodiments herein.

In another embodiment, a controller 267 may be a control device for the power generator 266. In some examples, the controller 267 is a motor/generator controller that may be utilized to operate a motor (the power generator 266) during system startup, and convert the variable frequency output of the power generator 266 into grid-acceptable power and provide speed regulation of the power generator 266 when the system is producing positive net power output. In some embodiments, the heat engine systems 100, 200 generally contain a process control system and a computer system (not shown). The computer system may contain a multi-controller algorithm utilized to control the multiple valves, pumps, and sensors within the heat engine systems 100, 200. By controlling the flow of the working fluid, the process control system is also operable to regulate the mass flows, temperatures, and/or pressures throughout the working fluid circuits 102, 202.

In some embodiments, the system pumps 150, 250 of the heat engine systems 100, 200 may be one or more pumps, such as a start pump, a turbopump, or both a start pump and a turbopump. The system pumps 150, 250 may be fluidly coupled to the working fluid circuits 102, 202 between the low pressure side and the high pressure side of the working fluid circuits 102, 202 and configured to circulate the working fluid through the working fluid circuits 102, 202. In another embodiment, as depicted in FIG. 6, the heat engine system 200 contains a turbopump 268 that has a pump portion, such as the system pump 250, coupled to an expander or the drive turbine, such as the expander 260. The pump portion may be fluidly coupled to the working fluid circuits 102, 202 between the low pressure side and the high pressure side and may be configured to circulate the working fluid through the working fluid circuits 102, 202. The drive turbine, or other expander, may be fluidly coupled to the working fluid circuits 102, 202 between the low pressure side and the high pressure side and may be configured to drive the pump portion by mechanical energy generated by the expansion of the working fluid.

The heat engine systems 100, 200 may further contain a mass management system 270 fluidly coupled to the low pressure side of the working fluid circuits 102, 202 and containing a mass control tank 272 and a working fluid supply tank 278, as depicted for the heat engine system 200 in FIG. 6. In some embodiments, the overall efficiency of the heat engine systems 100, 200 and the amount of power ultimately generated can be influenced by the use of the mass management system ("MMS") 270. The mass management system 270 may be utilized to control a transfer pump by regulating the amount of working fluid entering and/or exiting the heat engine systems 100, 200 at strategic locations in the working fluid circuits 102, 202, such as the inventory return line, the inventory supply line, as well as at tie-in points, inlets/outlets, valves, or conduits throughout the heat engine systems 100, 200.

In one embodiment, the mass management system 270 contains at least one storage vessel or tank, such as the mass control tank 272, configured to contain or otherwise store the working fluid therein. The mass control tank 272 may be fluidly coupled to the low pressure side of the working fluid circuits 102, 202, may be configured to receive the working fluid from the working fluid circuits 102, 202, and/or may be configured to distribute the working fluid into the working fluid circuits 102, 202. The mass control tank 272 may be a storage tank/vessel, a cryogenic tank/vessel, a cryogenic storage tank/vessel, a fill tank/vessel, or other type of tank, vessel, or container fluidly coupled to the working fluid circuits 102, 202.

The mass control tank 272 may be fluidly coupled to the low pressure side of the working fluid circuits 102, 202 via one or more fluid lines (e.g., the inventory return/supply lines) and valves (e.g., the inventory return/supply valves). The valves are moveable—as being partially opened, fully opened, and/or closed—to either remove working fluid from the working fluid circuits 102, 202 or add working fluid to the working fluid circuits 102, 202. Exemplary embodiments of the mass management system 270, and a range of variations thereof, are found in U.S. application Ser. No. 13/278,705, filed Oct. 21, 2011, and published as U.S. Pub. No. 2012-0047892, the contents of which are incorporated herein by reference to the extent consistent with the present disclosure.

In some embodiments, the mass control tank 272 may be configured as a localized storage tank for additional/supplemental working fluid that may be added to the heat engine system 90, 200 when desired in order to regulate the pressure or temperature of the working fluid within the working fluid circuits 102, 202 or otherwise supplement escaped working fluid. By controlling the valves, the mass management system 270 adds and/or removes working fluid mass to/from the heat engine systems 100, 200 with or without the need of a pump, thereby reducing system cost, complexity, and maintenance.

Additional or supplemental working fluid may be added to the mass control tank 272, hence, added to the mass management system 270 and the working fluid circuits 102, 202, from an external source, such as by a fluid fill system via at least one connection point or fluid fill port, such as a working fluid feed. Exemplary fluid fill systems are described and illustrated in U.S. Pat. No. 8,281,593, the contents of which are incorporated herein by reference to the extent consistent with the present disclosure. In some embodiments, a working fluid storage vessel 278 may be fluidly coupled to the working fluid circuits 102, 202 and utilized to supply supplemental working fluid into the working fluid circuits 102, 202.

In another embodiment described herein, seal gas may be supplied to components or devices contained within and/or utilized along with the heat engine systems 100, 200. One or multiple streams of seal gas may be derived from the working fluid within the working fluid circuits 102, 202 and contain carbon dioxide in a gaseous, subcritical, or supercritical state. In some examples, the seal gas supply is a connection point or valve that feeds into a seal gas system. A gas return is generally coupled to a discharge, recapture, or return of seal gas and other gases. The gas return provides a feed stream into the working fluid circuits 102, 202 of recycled, recaptured, or otherwise returned gases—generally derived from the working fluid. The gas return may be fluidly coupled to the working fluid circuits 102, 202 upstream of the coolers 140, 240 and downstream of the recuperators 130*a*-130*c* and 230.

The heat engine systems 100, 200 contain a process control system communicably connected, wired and/or wirelessly, with numerous sets of sensors, valves, and pumps, in order to process the measured and reported temperatures, pressures, and mass flowrates of the working fluid at the designated points within the working fluid circuits 102, 202. In response to these measured and/or reported parameters, the process control system may be operable to selectively adjust the valves in accordance with a control program or algorithm, thereby maximizing operation of the heat engine systems 100, 200.

The process control system may operate with the heat engine systems 100, 200 semi-passively with the aid of several sets of sensors. The first set of sensors is arranged at or adjacent the suction inlet of the turbopump and the start pump and the second set of sensors is arranged at or adjacent the outlet of the turbopump and the start pump. The first and second sets of sensors monitor and report the pressure, temperature, mass flowrate, or other properties of the working fluid within the low and high pressure sides of the working fluid circuits 102, 202 adjacent the turbopump and the start pump. The third set of sensors may be arranged either inside or adjacent the mass control tank 272 of the mass management system 270 to measure and report the pressure, temperature, mass flowrate, or other properties of the working fluid within the mass control tank 272. Additionally, an instrument air supply (not shown) may be coupled to sensors, devices, or other instruments within the heat engine systems 100, 200 and/or the mass management system 270 that may utilized a gaseous source, such as nitrogen or air.

Embodiments of the disclosure generally provide heat engine systems and methods for transforming energy, such as generating mechanical energy and/or electrical energy from thermal energy. Embodiments provide that the heat engine systems may have one of several different configurations of a working fluid circuit. In one embodiment, a carbon dioxide-based power cycle includes a working fluid pumped from a low pressure to a high pressure, raising the high pressure fluid temperature (through heat addition), expanding the fluid through a work producing device (such as a turbine), then cooling the low pressure fluid back to its starting point (through heat rejection to the atmosphere). This power cycle may be augmented through various heat recovery devices such as recuperators and other external heat exchangers. The effectiveness of adding heat is an important factor during the operation of such power cycle. Poorly designed cycles can be inefficient at heat to electrical power conversion in addition to requiring large heat exchangers to perform the task. Such systems deliver power at a much higher cost per kilowatt than the highly optimized systems described by embodiments herein. High pressure and temperature heat exchangers account for a large portion of the total cost of a sc-$CO_2$ system and maintaining high temperature differences across the heat exchangers provide the ability to utilize a cheaper and smaller heat exchanger.

Figure 9:
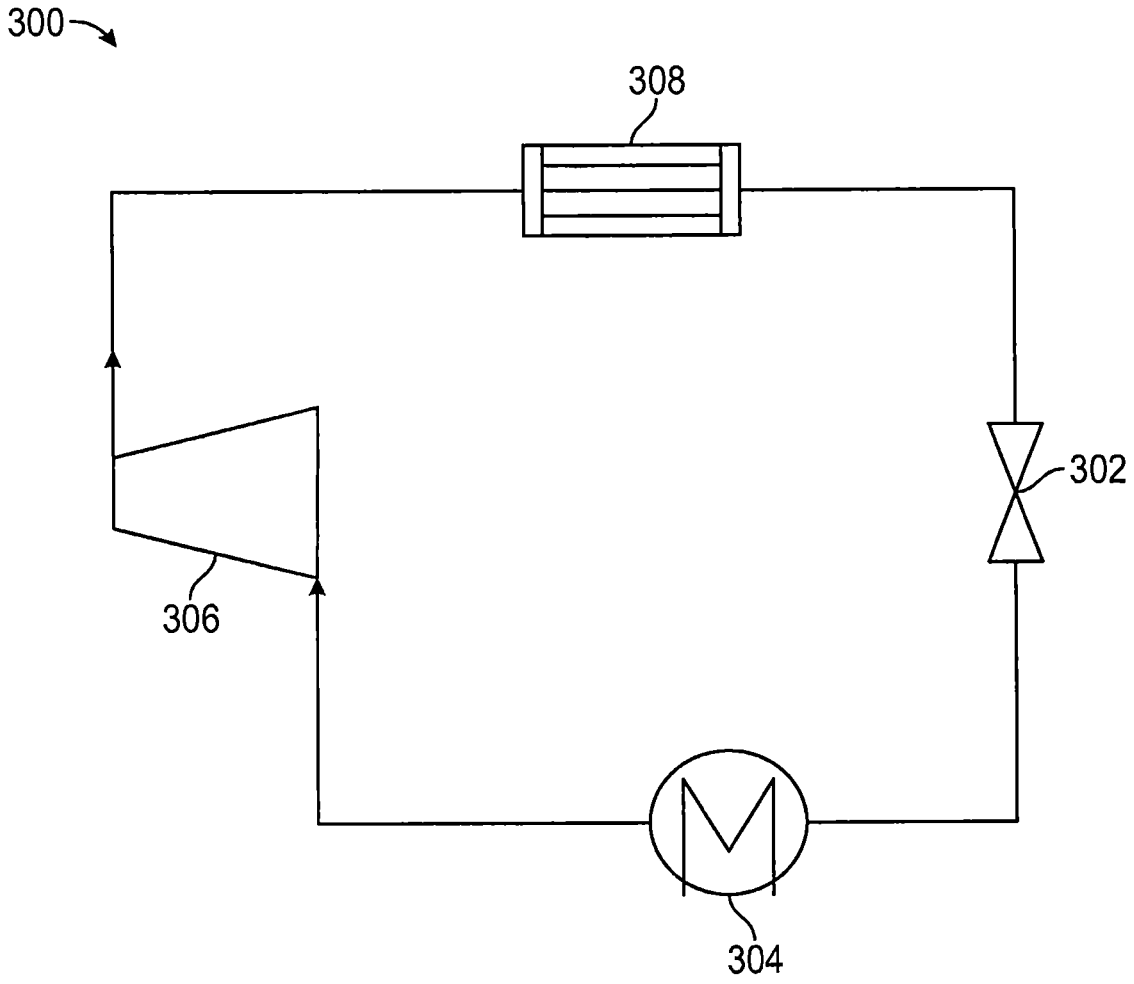
FIG. 9 depicts a power cycle, according to one or more embodiments disclosed herein.
Figure 10:
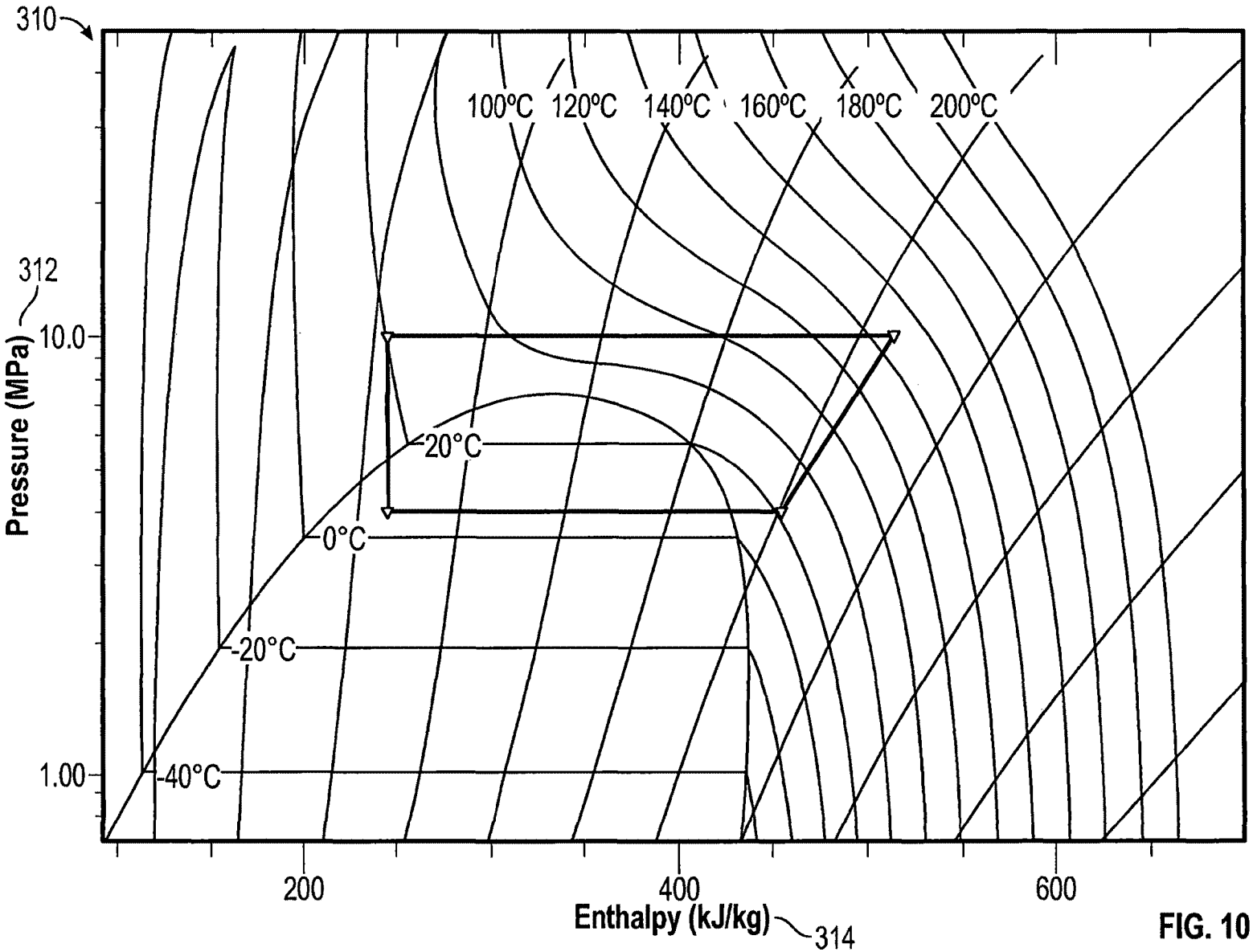
FIG. 10 depicts a pressure versus enthalpy diagram for the power cycle depicted in FIG. 9, according to one or more embodiments disclosed herein.

In one embodiment described herein and depicted in FIG. 9, a power cycle 300 includes a valve or orifice 302, a cooling heat exchanger 304, a compressor 306, and a condenser/cooler 308. In this embodiment, the power cycle 300 utilizes a vapor compression refrigeration process whereby a gas/vapor is compressed, cooled, and then expanded through the valve or orifice 302 usually into the vapor dome as a liquid and vapor mixture at much colder temperatures. The 'warm' stream is then passed over the cold coils at 304, removing heat and reducing the temperature of the warm stream. FIG. 10 depicts a pressure 312 versus enthalpy 314 diagram 310 for the power cycle 300 depicted in FIG. 9.

Figure 11:
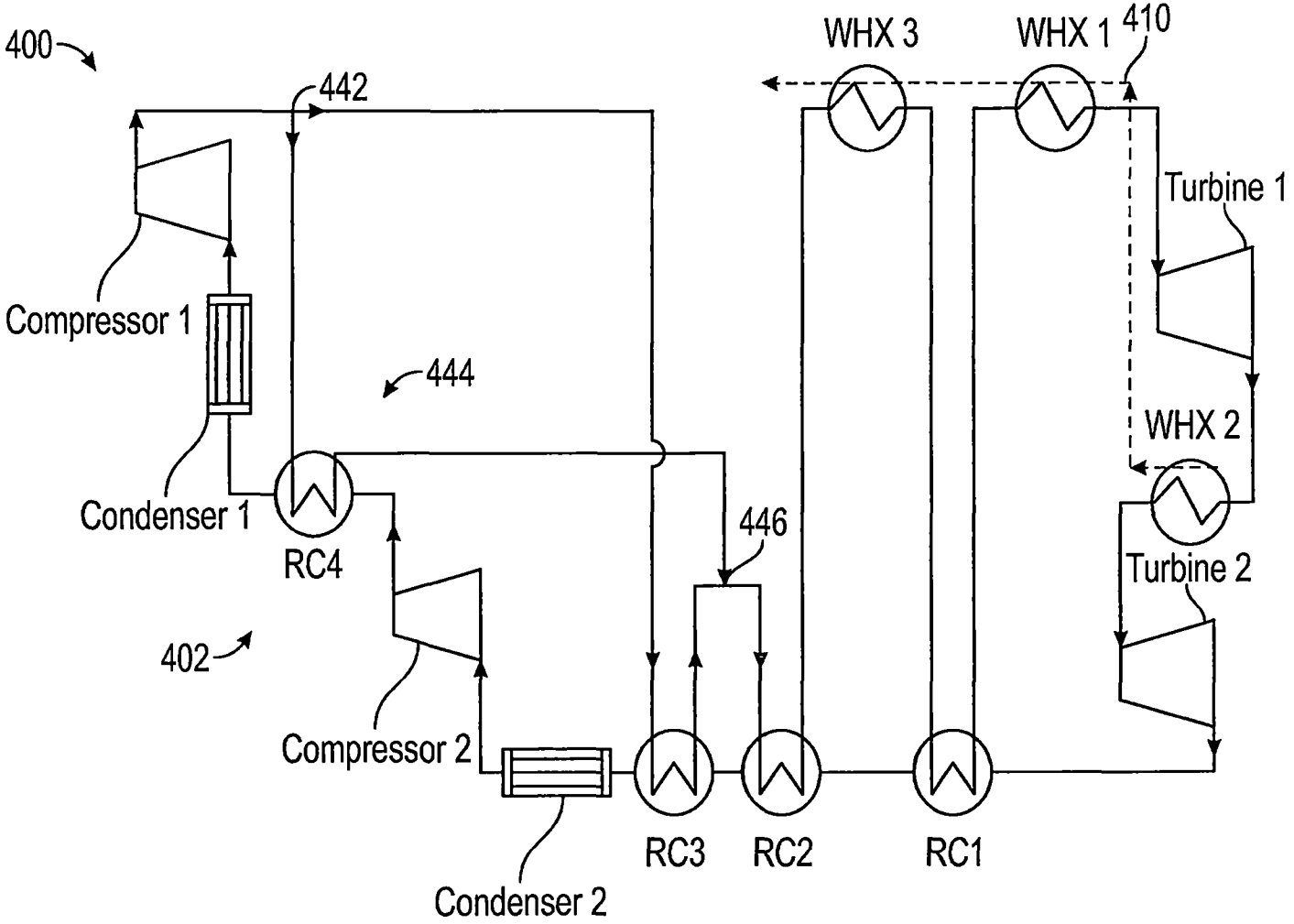
FIG. 11 depicts another exemplary heat engine system containing a working fluid circuit with a split flowpath, according to one or more embodiments disclosed herein.

In one or more embodiments described herein and depicted in FIG. 11, a heat engine system 400 with the depicted power cycle may utilize various devices and processes in numerous arrangements. In one exemplary embodiment, the heat engine system 400 with the depicted power cycle, may be outlined with two compressors (or stages) and two turbines (or stages), but is not limited to using only two of those components. There is the ability to intercool between the compression stages and to reheat between the expansion stages. However, high efficiency of the cycle may be provided by implementing recuperation prior to the first stage of compression (RC3) and after the first stage compression (RC4). The recuperation of these streams allows all or substantially all of the energy put into compressor 2 to be captured and reused throughout the system. Additionally, since recuperators (RC3 and RC4) are in parallel, by splitting the discharge flow of the compressor 1, the maximum temperature can be dropped across both heat recuperators (RC3 and RC4) allowing much more energy to be recovered than previous cycles of similar architecture. This cycle also has its compressors (compressors 1 and 2) in series instead of parallel, which reduces 'cross-talk' between the compressors that leads to system instability.

Figure 12:
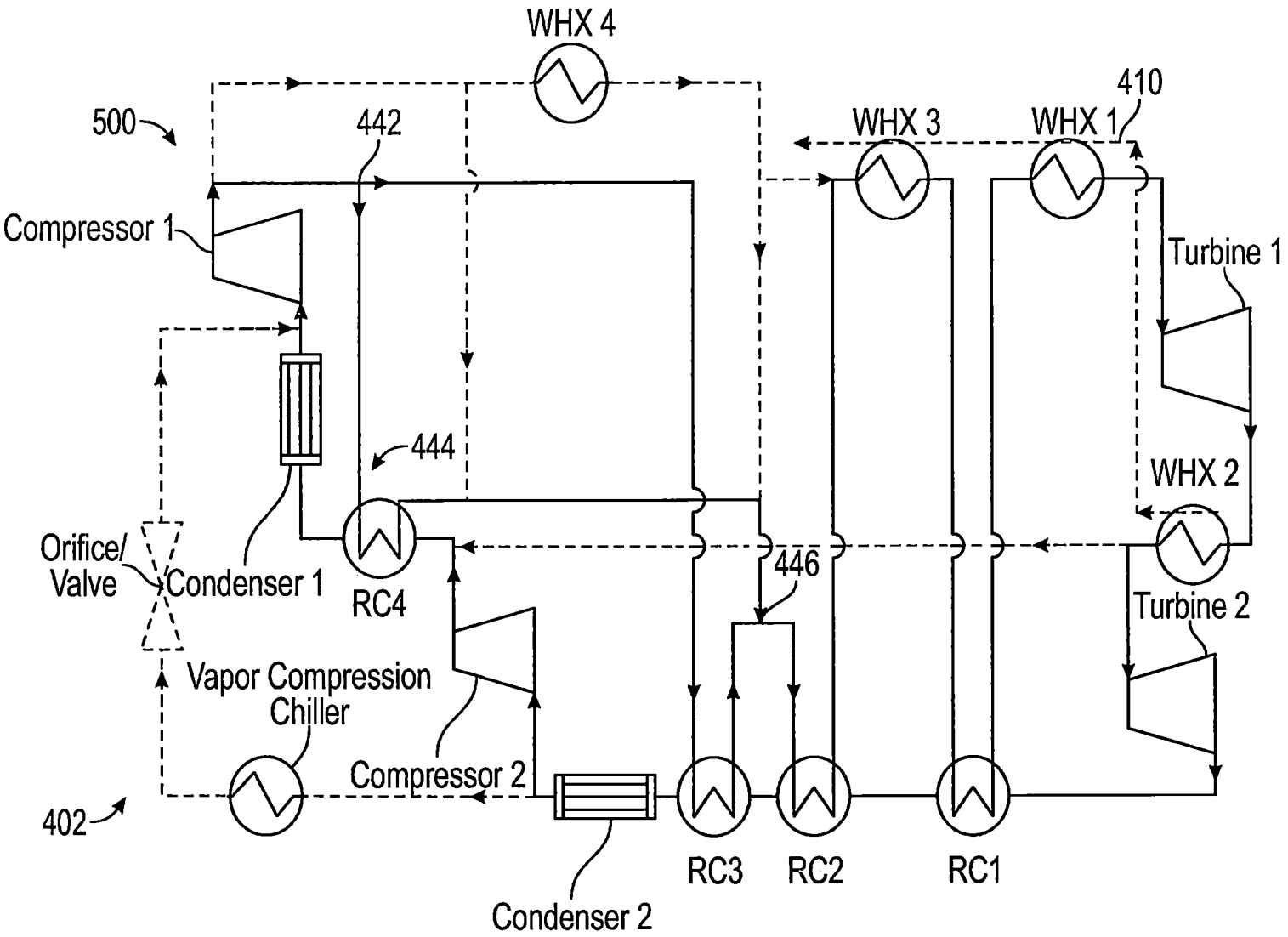
FIG. 12 depicts additional exemplary heat engine systems containing several variations of the working fluid circuit with one or more split flowpaths, according to multiple embodiments disclosed herein.

In other embodiments described herein and depicted in FIG. 12, a heat engine system 500 with a power cycle is illustrated with multiple dashed lines to represent multiple embodiments of several variations on this cycle. Vapor compression chilling can be taken out after condenser 1 and reintroduced prior to the compression 2 stage to provide cooling for some an external process. In some embodiments of the heat engine system 500, certain applications also include various combinations of WHX4 to be incorporated in parallel or series with other recuperators to effectively utilize a heat source, and a few potential paths are outlined merely as examples, but not meant to limit the various combinations of presently contemplated embodiments. The reheat stage may be tapped off to provide additional enthalpy if needed, much like a feed water heater in a typical steam cycle.

Figure 13:
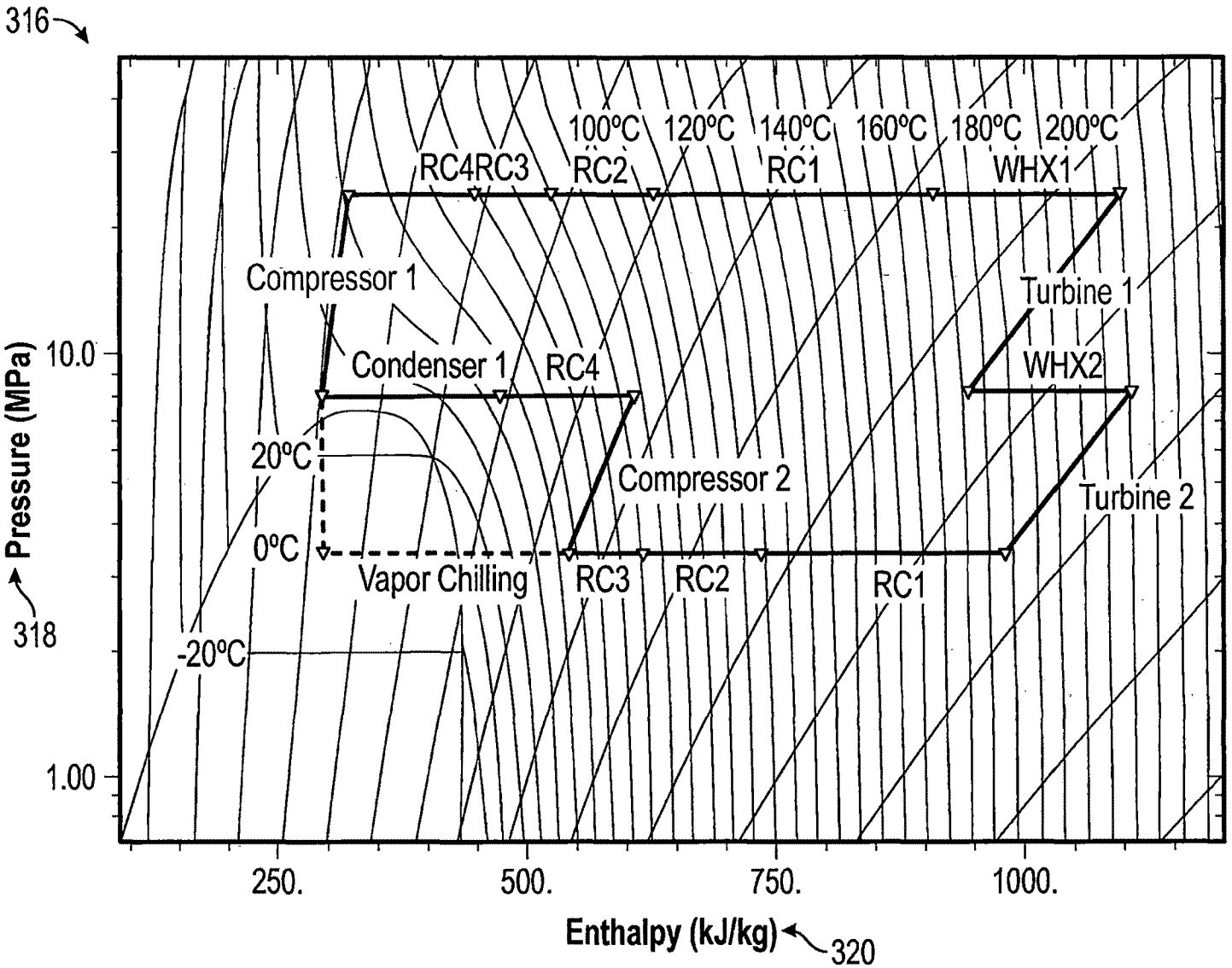
FIG. 13 depicts a pressure versus enthalpy diagram for the power cycles utilized by the heat engine systems depicted in FIGS. 11 and 12.

The heat of compression from the first stage compressor (compressor 2 in the diagram below and in the document) is fully recovered through the use of the split low temperature recuperator. None, or substantially none, of the heat transformed by the compression of the hot gas is rejected to the atmosphere; rather, it is recovered for use in the rest of the cycle. The split nature of the recuperator provides the maximum amount of heat that may be recovered prior to compression, independently of where the inlet of the other compressors may be. In one embodiment, the heat engine may have only one expander or turbine, while in other embodiments, the heat engine may have two or more expanders or turbines. FIG. 13 depicts a pressure 318 versus enthalpy 320 diagram 316 for the power cycles utilized by the heat engine systems 400, 500 depicted in FIGS. 11 and 12.

In some exemplary embodiments, as depicted in FIGS. 11-13, the following elements may be correlated as follows:

first waste heat exchanger (WHX1);
second waste heat exchanger (WHX2);
third waste heat exchanger (WHX3);
first turbine (Turbine 1);
second turbine (Turbine 2);
first recuperator (RC1);
second recuperator (RC2);
third recuperator (RC3);
fourth recuperator (RC4);
first condenser (Condenser 1);
second condenser (Condenser 2);
first compressor (Compressor 1); and
second compressor (Compressor 2).

In one or more embodiments described herein, the heat engine systems 400, 500 may contain a working fluid circuit 402 having a high pressure side and a low pressure side and also contain a working fluid. Generally, at least a portion of the working fluid circuit 402 may contain the working fluid in a supercritical state and the working fluid contains carbon dioxide. The heat engine system 400, 500 may further contain a first waste heat exchanger, a second waste heat exchanger, and a third waste heat exchanger fluidly coupled to and in thermal communication with the high pressure side of the working fluid circuit 402. Each of the first, second, and third waste heat exchangers may be configured to be fluidly coupled to and in thermal communication with one or more heat sources or heat streams 410 and may be configured to transfer thermal energy from the one or more heat sources or heat streams 410 to the working fluid within the high pressure side.

In some embodiments, the heat engine system 400, 500 may also contain a first turbine and a second turbine fluidly coupled to the working fluid circuit 402 and configured to convert a pressure drop in the working fluid to mechanical energy. The heat engine system 400, 500 may also contain a first compressor and a second compressor fluidly coupled to the working fluid circuit 402 and configured to pressurize or circulate the working fluid within the working fluid circuit 402.

The heat engine system 400, 500 may further contain a first recuperator, a second recuperator, a third recuperator, and a fourth recuperator fluidly coupled to the working fluid circuit 402 and configured to transfer thermal energy from the low pressure side to the high pressure side of the working fluid circuit 402. Each of the first, second, third, and fourth recuperators further contains a cooling portion fluidly coupled to the low pressure side and configured to transfer thermal energy from the working fluid flowing through the low pressure side and a heating portion fluidly coupled to the high pressure side and configured to transfer thermal energy to the working fluid flowing through the high pressure side. The heat engine system 400, 500 may also contain a first condenser and a second condenser in thermal communication with the working fluid in the working fluid circuit 402 and configured to remove thermal energy from the working fluid in the working fluid circuit 402.

Additionally, the heat engine system 400, 500 may contain a split flowpath 444, a split junction 442, and a recombined junction 446 disposed within the high pressure side of the working fluid circuit 402. The split flowpath 444 may extend from the split junction 442, through the heating portion of the fourth recuperator, and to the recombined junction 446. The split junction 442 may be disposed downstream of the first compressor and upstream of the heating portions of the third and fourth recuperators. The recombined junction 446 may be disposed downstream of the heating portions of the third and fourth recuperators and upstream of the heating portion of the second recuperator.

In some examples, the first turbine may be disposed downstream of the first waste heat exchanger and upstream of the second waste heat exchanger and the second turbine may be disposed downstream of the second waste heat exchanger and upstream of the cooling portion of the first recuperator. In other examples, the first recuperator may be disposed downstream of the second turbine and upstream of the cooling portion of the second recuperator on the low pressure side and disposed downstream of the third waste heat exchanger and upstream of the first waste heat exchanger on the high pressure side. The cooling portions of the first recuperator, the second recuperator, and the third recuperator may be serially disposed on the low pressure side. The cooling portion of the third recuperator, the second condenser, and the second compressor may be serially disposed on the low pressure side. The cooling portion of the fourth recuperator, the first condenser, and the first compressor may be serially disposed on the working fluid circuit 402.

In other exemplary configurations, the heating portion of the second recuperator, the third waste heat exchanger, the heating portion of the first recuperator, and the first waste heat exchanger may be serially disposed on the high pressure side upstream of the first turbine. In one example, the first compressor and the heating portion of the third recuperator may be serially disposed on the high pressure side upstream of the heating portion of the second recuperator. In another example, the first compressor and the heating portion of the fourth recuperator may be serially disposed on the high pressure side upstream of the heating portion of the second recuperator.

The heat engine systems 400, 500 may contain a first driveshaft coupled to and between the first turbine and the first compressor, wherein the first driveshaft is configured to drive the first compressor with the mechanical energy produced by the first turbine. Also, the heat engine system 400, 500 may contain a second driveshaft coupled to and between the second turbine and the second compressor, wherein the second driveshaft is configured to drive the second compressor with the mechanical energy produced by the second turbine. The first condenser, the second condenser, or both of the first and second condensers, may be disposed within the low pressure side of the working fluid circuit 402, are in thermal communication with the working fluid in the low pressure side of the working fluid circuit 402, and are configured to remove thermal energy from the working fluid in the low pressure side of the working fluid circuit 402.

In some exemplary configurations, the high pressure side of the working fluid circuit 402 is downstream of the first turbine or the second turbine and upstream of the first compressor or the second compressor, and the low pressure side of the working fluid circuit 402 is downstream of the first compressor or the second compressor and upstream of the first turbine or the second turbine.

Figure 14:
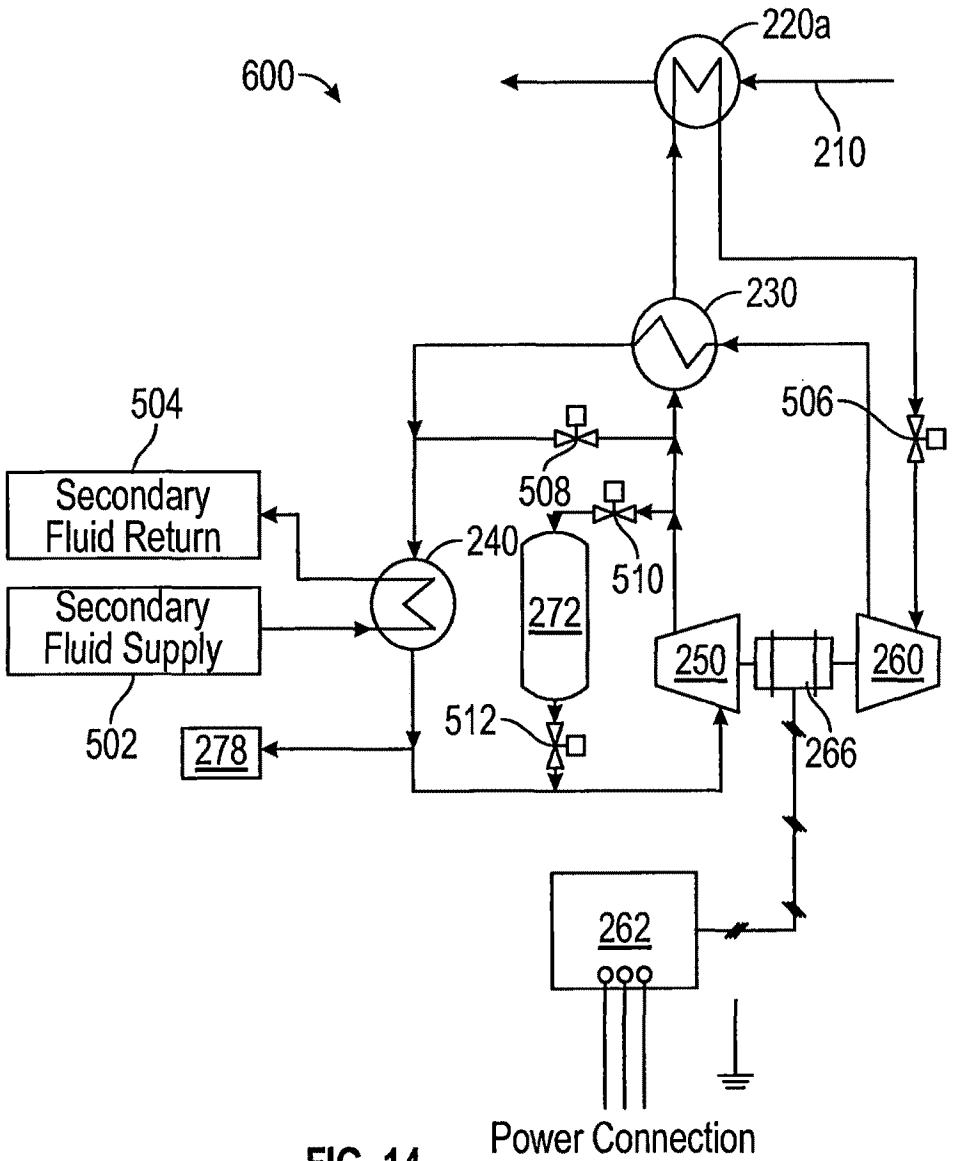
FIG. 14 depicts another exemplary heat engine system having a simple recuperated power cycle, according to one or more embodiments disclosed herein.

FIG. 14 illustrates another embodiment of a heat engine system 600 having a simple recuperated power cycle. In this embodiment, the power cycle begins at the inlet to the cooler or condenser 240 where the working fluid is cooled by transferring heat to a secondary fluid from secondary fluid supply 502, which returns to a secondary fluid return 504 after cooling the working fluid. However, this beginning point is chosen for illustrative purposes only since the power cycle is a closed loop circuit and may begin at any point in the loop. In some embodiments, the secondary fluid may be fresh or sea water while in other embodiments, the secondary fluid may be air or other media. Depending on the temperature of the secondary fluid and the size of condenser 240, the fluid at the outlet of the condenser 240 and the inlet to the pump 250 may be either in a liquid state or in a supercritical state. In both embodiments, the fluid density may be relatively high and the compressibility relatively low compared to the other states within the cycle.

The pump 250 uses shaft work to increase the pressure of the working fluid at its discharge. The working fluid then enters heat exchanger 230, in which its temperature is raised by enabling it to absorb residual heat from the fluid at the turbine 260 discharge. The preheated fluid enters the heat exchanger 220*a*, where it absorbs additional heat from an external source 210, such as a hot exhaust stream from another engine or other heat source. The preheated fluid is then expanded through turbine 260, creating shaft work that is used to both drive the pump 250, and to generate electrical power through the power generator 266, which may be a motor/alternator or a motor/generator in some embodiments. The expanded fluid then rejects some of its residual heat in heat exchanger 230 and then enters condenser 240, completing the cycle.

The other components shown in FIG. 14 are for operation and control of the main fluid loop. For example, valve 506 is a shutoff valve that provides emergency shut-down of the system and regulation of the power output of the system. Further, the valve 508 is a valve that can be used to allow for some amount of excess flow from the pump 250 discharge to bypass the remainder of the system in order to maintain proper operation of the pup 250 and to regulate the power output of the system. Valves 510 and 512, as well as storage tank 272 are used to regulate the amount of working fluid contained in the main fluid loop, thereby actively controlling the inlet pressure to the pump 250 in response to changes in operating and boundary conditions (e.g. coolant and heat source temperatures). The controller 267 serves to operate the power generator 266 as a motor during system startup, to convert the variable frequency output of the power generator 266 into grid-acceptable power, and to provide speed regulation of the power generator 266, the expander 260, and the pump 250 when the system is producing positive net power output.

Figure 15:
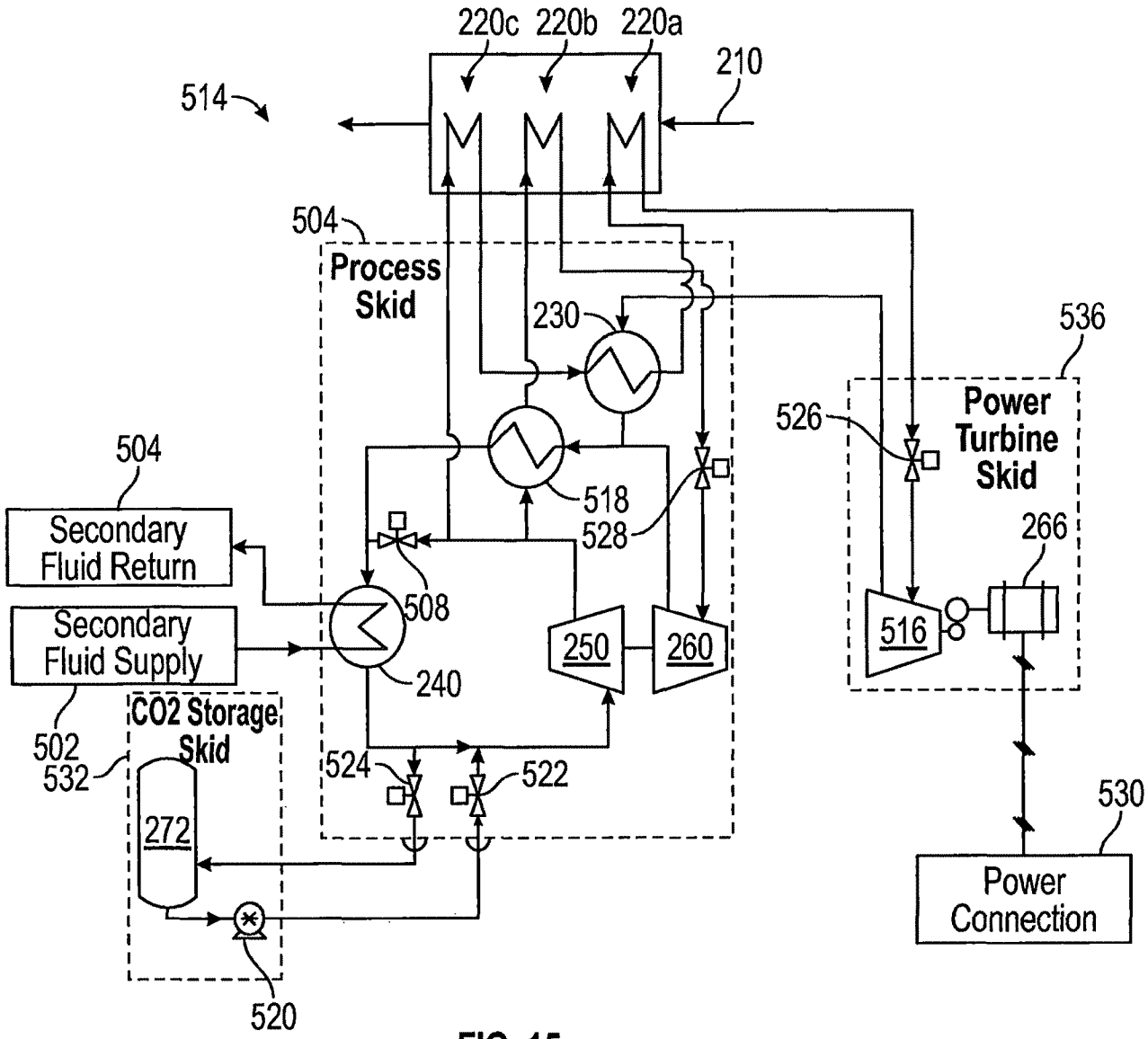
FIG. 15 depicts another exemplary heat engine system having an advanced parallel power cycle, according to one or more embodiments disclosed herein.

FIG. 15 illustrates another embodiment of a heat engine system 514 having an advanced parallel cycle in accordance with another embodiment. In this embodiment, the fluid exiting the pump 250 is split into two streams. The first stream enters heat exchanger 220*c*, the third of a series of three external heat exchangers 220*a*, 220*b*, and 220*c*, which sequentially remove heat from the high temperature fluid heat source 210 and transfer it to the working fluid. The fluid exiting heat exchanger 220*c* is additionally heated in the heat exchanger 230 by residual heat from the working fluid exiting a second turbine 516. Finally, the fluid is additionally heated in the heat exchanger 220*a*, at which point it is expanded through the second turbine 516, creating shaft work. This shaft work is used to rotate power generator 266, which in some embodiments, may be an alternator or generator. The fluid exiting the second turbine 515 enters the heat exchanger 230 to provide the aforementioned preheating for the fluid between the heat exchanger 220*c* and the heat exchanger 220*a*.

The second stream exiting the pump 250 enters another recuperator or heat exchanger 518, where it is preheated by higher temperature working fluid, before being additionally heated in the heat exchanger 220*b*. The fluid is then expanded through the turbine 260, which provides the shaft work to rotate the pump 250 through a mechanical coupling. The fluid exiting the turbine 260 combines with the first stream after it has exited the heat exchanger 230. This combined flow provides the heat source to preheat the second stream in the heat exchanger 518. Finally, the combined stream enters the condenser 240, completing the cycle.

Due to the larger size of the system 514 compared to the system 600, in some embodiments, a low-temperature $CO_2$ storage tank 272 is used to provide fluid for pressure control of the main system, rather than the higher pressure tank in the systems 600 and 200. Additional fluid enters the system via feed pump 520 through valve 522 and exits the system through valve 524. Valves 526 and 528 provide throttling, system control, and emergency shut-down similar to valve 506 in the system 600. In some embodiments, the power generator 266 may be a synchronous generator, and speed control is provided by direct power connection 530 to an electrical grid. Further, in the illustrated embodiment, the components are arranged on a carbon dioxide storage skid 532, a process skid 534, and a power turbine skid 536, but in other embodiments, the components may be arranged or coupled in any suitable manner, depending on implementation-specific considerations.

It is to be understood that the present disclosure describes several exemplary embodiments for implementing different features, structures, or functions of the disclosure. Exemplary embodiments of components, arrangements, and configurations are described herein to simplify the present disclosure, however, these exemplary embodiments are provided merely as examples and are not intended to limit the scope of the disclosure. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the present disclosure may include embodiments in which the first and second features are formed in direct contact, and may also include embodiments in which additional features may be formed interposing the first and second features, such that the first and second features may not be in direct contact. Finally, the exemplary embodiments described herein may be combined in any combination of ways, i.e., any element from one exemplary embodiment may be used in any other exemplary embodiment without departing from the scope of the disclosure.

Additionally, certain terms are used throughout the written description and claims to refer to particular components. As one skilled in the art will appreciate, various entities may refer to the same component by different names, and as such, the naming convention for the elements described herein is not intended to limit the scope of the disclosure, unless otherwise specifically defined herein. Further, the naming convention used herein is not intended to distinguish between components that differ in name but not function. Further, in the written description and in the claims, the terms "including", "containing", and "comprising" are used in an open-ended fashion, and thus should be interpreted to mean "including, but not limited to". All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B", unless otherwise expressly specified herein.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A heat engine system, comprising:

a working fluid circuit having a high pressure side and a low pressure side and configured to flow a working fluid therethrough, wherein at least a portion of the working fluid circuit contains the working fluid in a supercritical state, and the working fluid comprises carbon dioxide;

a plurality of heat exchangers, wherein each of the heat exchangers is fluidly coupled to and in thermal communication with the high pressure side of the working fluid circuit, configured to be fluidly coupled to and in thermal communication with a heat source, and configured to transfer thermal energy from the heat source to the working fluid within the high pressure side;

a plurality of recuperators, wherein each of the recuperators is fluidly coupled to the working fluid circuit and configured to transfer thermal energy between the high pressure side and the low pressure side of the working fluid circuit, wherein the plurality of heat exchangers and the plurality of recuperators are sequentially and alternatingly disposed in the working fluid circuit;

an expander fluidly coupled to the working fluid circuit, disposed between the high pressure side and the low pressure side, and configured to convert a pressure drop in the working fluid to mechanical energy;

a driveshaft coupled to the expander and configured to drive a device with the mechanical energy;

a system pump fluidly coupled to the working fluid circuit between the low pressure side and the high pressure side of the working fluid circuit and configured to circulate or pressurize the working fluid within the working fluid circuit; and a cooler in thermal communication with the working fluid in the low pressure side of the working fluid circuit and configured to remove thermal energy from the working fluid in the low pressure side of the working fluid circuit.

2. The heat engine system of claim 1, wherein the plurality of heat exchangers comprises four or more heat exchangers.

3. The heat engine system of claim 2, wherein the plurality of recuperators comprises three or more recuperators.

4. The heat engine system of claim 3, wherein a first recuperator is disposed between a first heat exchanger and a second heat exchanger, a second recuperator is disposed between the second heat exchanger and a third heat exchanger, and a third recuperator is disposed between the third heat exchanger and a fourth heat exchanger.

5. The heat engine system of claim 4, wherein the first heat exchanger is disposed downstream of the first recuperator and upstream of the expander on the high pressure side.

6. The heat engine system of claim 4, wherein the fourth heat exchanger is disposed downstream of the system pump and upstream of the third recuperator on the high pressure side.

7. The heat engine system of claim 4, wherein the cooler comprises a condenser disposed downstream of the third recuperator and upstream of the system pump on the low pressure side.

8. The heat engine system of claim 1, further comprising a mass management system fluidly coupled to the low pressure side of the working fluid circuit and comprising a mass control tank.

9. The heat engine system of claim 1, further comprising a variable frequency drive coupled to the system pump and configured to control mass flow rate or temperature of the working fluid within the working fluid circuit.

10. The heat engine system of claim 1, wherein the system pump is coupled to the expander by the driveshaft and configured to control mass flow rate or temperature of the working fluid within the working fluid circuit.

11. The heat engine system of claim 1, wherein the system pump is coupled to a second expander and configured to control mass flow rate or temperature of the working fluid within the working fluid circuit.

12. The heat engine system of claim 1, further comprising a generator or an alternator coupled to the expander by the driveshaft and configured to convert the mechanical energy into electrical energy.

13. The heat engine system of claim 1, further comprising a turbopump in the working fluid circuit, wherein the turbopump contains a pump portion coupled to the expander by the driveshaft, and the pump portion is configured to be driven by the mechanical energy.

14. A heat engine system, comprising:

a working fluid circuit having a high pressure side and a low pressure side and configured to flow a working fluid therethrough, wherein at least a portion of the working fluid circuit contains the working fluid in a supercritical state, and the working fluid comprises carbon dioxide;

a high-temperature heat exchanger and a low-temperature heat exchanger, wherein each of the high-temperature and low-temperature heat exchangers is fluidly coupled to and in thermal communication with the high pressure side of the working fluid circuit and configured to be fluidly coupled to and in thermal communication with a heat source, and wherein the high-temperature heat exchanger is configured to transfer thermal energy from the heat source to the working fluid within the high pressure side at a first temperature, and the low-temperature heat exchanger is configured to transfer thermal energy from the heat source to the working fluid within the high pressure side at a second temperature lower than the first temperature;

a recuperator fluidly coupled to the working fluid circuit and configured to transfer thermal energy between the high pressure side and the low pressure side of the working fluid circuit;

an expander fluidly coupled to the working fluid circuit and disposed between the high pressure side and the low pressure side and configured to convert a pressure drop in the working fluid to mechanical energy;

a driveshaft coupled to the expander and configured to drive a device with the mechanical energy;

a system pump fluidly coupled to the working fluid circuit between the low pressure side and the high pressure side of the working fluid circuit and configured to circulate or pressurize the working fluid within the working fluid circuit;

a cooler in thermal communication with the working fluid in the low pressure side of the working fluid circuit and configured to remove thermal energy from the working fluid in the low pressure side of the working fluid circuit;

a split flowpath contained in the high pressure side of the working fluid circuit, wherein the split flowpath comprises a split junction disposed downstream of the system pump and upstream of the low-temperature heat exchanger and the recuperator; and a recombined flowpath contained in the high pressure side of the working fluid circuit, wherein the recombined flowpath comprises a recombined junction disposed downstream of the low-temperature heat exchanger and the recuperator and upstream of the high-temperature heat exchanger.

15. The heat engine system of claim 14, wherein the split flowpath extends from the split junction to the low-temperature heat exchanger and the recuperator.

16. The heat engine system of claim 14, wherein the recombined flowpath extends from the low-temperature heat exchanger and the recuperator to the recombined junction.

17. A heat engine system, comprising:

a working fluid circuit having a high pressure side and a low pressure side and configured to flow a working fluid therethrough, wherein at least a portion of the working fluid circuit contains the working fluid in a supercritical state, and the working fluid comprises carbon dioxide;

a high-temperature heat exchanger and a low-temperature heat exchanger, wherein each of the high-temperature and low-temperature heat exchangers is fluidly coupled to and in thermal communication with the high pressure side of the working fluid circuit, configured to be fluidly coupled to and in thermal communication with a heat source, and configured to transfer thermal energy from the heat source to the working fluid within the high pressure side;

a recuperator fluidly coupled to the working fluid circuit and configured to transfer thermal energy between the high pressure side and the low pressure side of the working fluid circuit;

an expander fluidly coupled to the working fluid circuit and disposed between the high pressure side and the low pressure side and configured to convert a pressure drop in the working fluid to mechanical energy;

a driveshaft coupled to the expander and configured to drive a device with the mechanical energy;

a system pump fluidly coupled to the working fluid circuit between the low pressure side and the high pressure side of the working fluid circuit and configured to circulate or pressurize the working fluid within the working fluid circuit;

a cooler in thermal communication with the working fluid in the low pressure side of the working fluid circuit and configured to remove thermal energy from the working fluid in the low pressure side of the working fluid circuit;

a bypass line having an inlet end and an outlet end and configured to flow the working fluid around the low-temperature heat exchanger and to the recuperator, wherein the inlet end of the bypass line is fluidly coupled to the high pressure side at a split junction disposed downstream of the system pump and upstream of the low-temperature heat exchanger, and the outlet end of the bypass line is fluidly coupled to an inlet of the recuperator on the high pressure side; and a recuperator fluid line having an inlet end and an outlet end, wherein the inlet end of the recuperator fluid line is fluidly coupled to an outlet of the recuperator on the high pressure side, and the outlet end of the recuperator fluid line is fluidly coupled to the high pressure side at a recombined junction disposed downstream of the low-temperature heat exchanger and upstream of the high-temperature heat exchanger.

18. The heat engine system of claim 17, further comprising a segment of the high pressure side configured to flow the working fluid from the system pump, through the bypass line, through the recuperator, through the recuperator fluid line, through the high-temperature heat exchanger, and to the expander.

19. The heat engine system of claim 17, further comprising an isolation shut-off valve or a modulating valve upstream of the split junction.

20. The heat engine system of claim 17, further comprising a three-way valve at the split junction or the recombined junction.

* * * * *